US010096402B2

(12) United States Patent
Tanabe et al.

(10) Patent No.: US 10,096,402 B2
(45) Date of Patent: Oct. 9, 2018

(54) MULTI-CORE CABLE AND PRODUCTION METHOD THEREFOR

(71) Applicant: Junkosha Inc., Kasama-shi (JP)

(72) Inventors: Suguru Tanabe, Kasama (JP); Tomohiro Adachi, Kasama (JP)

(73) Assignee: Junkosha Inc., Kasama-shi, Ibaraki (JP)

( * ) Notice: Subject to any disclaimer, the term of this patent is extended or adjusted under 35 U.S.C. 154(b) by 0 days.

(21) Appl. No.: 15/531,614

(22) PCT Filed: Nov. 25, 2015

(86) PCT No.: PCT/JP2015/083138
§ 371 (c)(1),
(2) Date: Aug. 2, 2017

(87) PCT Pub. No.: WO2016/084869
PCT Pub. Date: Jun. 2, 2016

(65) Prior Publication Data

US 2017/0330652 A1 Nov. 16, 2017

(30) Foreign Application Priority Data

| | | |
|---|---|---|
| Nov. 28, 2014 | (JP) | 2014-240869 |
| Mar. 18, 2015 | (JP) | 2015-055446 |
| Mar. 24, 2015 | (JP) | 2015-061099 |
| Aug. 20, 2015 | (JP) | 2015-163274 |
| Aug. 25, 2015 | (JP) | 2015-166295 |
| Aug. 26, 2015 | (JP) | 2015-167265 |
| Sep. 1, 2015 | (JP) | 2015-172403 |

(51) Int. Cl.

| | |
|---|---|
| ***H01B 7/00*** | (2006.01) |
| ***H01B 3/30*** | (2006.01) |
| ***H01B 11/12*** | (2006.01) |
| ***H01B 13/004*** | (2006.01) |
| ***H01B 13/00*** | (2006.01) |
| ***H01B 7/02*** | (2006.01) |

(52) U.S. Cl.
CPC ..... *H01B 11/12* (2013.01); *H01B 7/0208* (2013.01); *H01B 13/004* (2013.01); *H01B 13/0006* (2013.01)

(58) Field of Classification Search
CPC .. H01B 11/12; H01B 13/004; H01B 13/0006; H01B 7/0208
USPC ..... 174/110 R, 113 R
See application file for complete search history.

(56) References Cited

U.S. PATENT DOCUMENTS

| | | | | |
|---|---|---|---|---|
| 6,982,385 | B2 * | 1/2006 | Wu | H01B 5/08 174/126.1 |
| 8,247,695 | B2 * | 8/2012 | Nakamura | H01B 9/026 174/113 R |
| 2013/0333917 | A1 | 12/2013 | Tanabe | |

FOREIGN PATENT DOCUMENTS

| | | | |
|---|---|---|---|
| CN | 1327240 | A | 12/2001 |
| CN | 1750177 | A | 3/2006 |
| CN | 201177999 | Y | 1/2009 |
| CN | 202694979 | U | 1/2013 |

(Continued)

*Primary Examiner* — Sherman Ng
(74) *Attorney, Agent, or Firm* — The Webb Law Firm

(57) ABSTRACT

Provided herein is a multi-core cable through which positions of a plurality of insulated conductors and a plurality of non-insulated conductors in a cross section in a longitudinal direction are changed and a likelihood of transmission performance being reduced is low. A multi-core cable includes n conductor bundles.

8 Claims, 13 Drawing Sheets

(56) References Cited

FOREIGN PATENT DOCUMENTS

| | | | |
|---|---|---|---|
| JP | 8321220 | A | 12/1996 |
| JP | 11162268 | A | 6/1999 |
| WO | 2012120993 | A1 | 9/2012 |

* cited by examiner

MULTI-CORE CABLE AND PRODUCTION METHOD THEREFOR

CROSS-REFERENCE TO RELATED APPLICATIONS

This application is the United States national phase of International Application No. PCT/JP2015/083138 filed Nov. 25, 2015, and claims priority to Japanese Patent Application No. 2014-240869 filed Nov. 28, 2014, Japanese Patent Application No. 2015-055446 filed Mar. 18, 2015, Japanese Patent Application No. 2015-061099 filed Mar. 24, 2015, Japanese Patent Application No. 2015-163274 filed Aug. 20, 2015, Japanese Patent Application No. 2015-166295 filed Aug. 25, 2015, Japanese Patent Application No. 2015-167265 filed Aug. 26, 2015, and Japanese Patent Application No. 2015-172403 filed Sep. 1, 2015, the disclosures of which are hereby incorporated in their entirety by reference.

TECHNICAL FIELD

The present invention relates to a multi-core cable and a production method therefor.

BACKGROUND ART

In order to reduce the diameter of a multi-core cable such as an ultrasonic probe cable and reduce a manufacturing cost, a configuration in which a coaxial cable is not used as a signal line for transmitting a signal is known. In Patent Literature 1, a multi-core cable including five insulated conductors and one non-insulated conductor is described. In the multi-core cable described in Patent Literature 1, five insulated conductors and one non-insulated conductor are arranged in rows on the outer circumference of a tension member and are wound helically. In the multi-core cable described in Patent Literature 1, since the insulated conductors and the non-insulated conductor are arranged in rows and wound helically, favorable flexibility can be obtained. In addition, since the multi-core cable described in Patent Literature 1 does not include a coaxial cable, it is possible to reduce the diameter and a manufacturing cost.

However, in the multi-core cable described in Patent Literature 1, when insulated conductors are adjacent to each other with no non-insulated conductor interposed therebetween, two of five insulated conductors are adjacent to the non-insulated conductor and three of the insulated conductors are not adjacent to the non-insulated conductor and the insulated conductors are adjacent to each other. Since these adjacent insulated conductors are arranged in parallel in a longitudinal direction of the insulated conductors as signal lines and a state in which capacitive coupling between signal lines does not change is continuous, crosstalk increases. As described above, since the insulated conductors are arranged in parallel with equal intervals therebetween, there are problems in that crosstalk increases, signal strength decreases and signal quality deteriorates.

CITATION LIST

Patent Literature

[Patent Literature 1]

Japanese Unexamined Patent Application no. H11-162268

SUMMARY OF INVENTION

Technical Problem

As described above, when only insulated conductors are arranged adjacent to each other, there are problems in that crosstalk increases, signal strength decreases and signal quality deteriorates. In addition, even if positions of insulated conductors and a non-insulated conductor are changed randomly along a length direction, when the distances between these insulated conductors and non-insulated conductor vary greatly, there are problems in that characteristic impedances do not match, there is more noise and reflected waves, and transmission performance of the multi-core cable decreases.

Therefore, the present invention provides a multi-core cable in which, in cross sections of a plurality of insulated conductors and a plurality of non-insulated conductors, a non-insulated conductor is always arranged close to an insulated conductor, positional relationships between the insulated conductors and between an insulated conductor and a non-insulated conductor are changed randomly along a length direction of the cable, and thus a likelihood of transmission performance being reduced is low.

Solution to Problem

A multi-core cable according to the present invention includes n conductor bundles, wherein the n conductor bundles each include at least one insulated conductor and at least one non-insulated conductor, a frequency of appearance of the same surface in cross sections perpendicular to a longitudinal direction of the conductor bundles is AF(N) (N=1 to n) per unit length, at least one AF(N) (N=1 to n) is different from the others, the ratio between the number of insulated conductors and the number of non-insulated conductors in each of the n conductor bundles is in a range of 2:3 to 4:1, a non-insulated conductor paired with an insulated conductor is not fixed, and each of the insulated conductors is paired with a non-insulated conductor of the same conductor bundle and/or a non-insulated conductor of a different conductor bundle.

In the multi-core cable according to the present invention, since at least one of the frequencies AF(N) (N=1 to n) of appearance of the same surface in cross sections perpendicular to a longitudinal direction of the conductor bundles is different from the others, it is possible to reduce crosstalk by changing capacitive coupling between the insulated conductors in a longitudinal direction. In addition, in the multi-core cable according to the present invention, when the ratio between the number of insulated conductors and the number of non-insulated conductors in each conductor bundle is set to be in a range of 2:3 to 4:1, an insulated conductor is arranged close to a non-insulated conductor. Therefore, it is possible to reduce variation in electrostatic capacity of the insulated conductors.

Unlike twisted pairs, in the multi-core cable according to the present invention, a non-insulated conductor paired with an insulated conductor is not fixed. That is, an insulated conductor and a non-insulated conductor may be paired in the same bundle, and an insulated conductor and a non-insulated conductor which are in adjacent different conductor bundles may be paired. For such reasons, the state is random beyond an apparent structure, and a crosstalk reduction effect is enhanced. Moreover, even in a configuration including a plurality of insulated conductors and fewer number of non-insulated conductors than the insulated conductors, a non-insulated conductor is always arranged close to an insulated conductor not only in a conductor bundle but also in the entire cable. Therefore, an effect enabling variation to be reduced in electrostatic capacity is further enhanced.

In addition, in the multi-core cable according to the present invention, the ratio between the number of insulated conductors and the number of non-insulated conductors in each of the n conductor bundles is preferably in a range of 1:1 to 4:1.

Moreover, in the multi-core cable according to the present invention, when the ratio between the number of insulated conductors and the number of non-insulated conductors in each of the n conductor bundles is in a range of 2:3 or more and less than 1:1, the ratio between an average value of diameters of the insulated conductors and an average value of diameters of the non-insulated conductors in the n conductor bundles is preferably in a range of 1.2:1 or more and 4:1 or less.

In addition, in the multi-core cable according to the present invention, in cross sections perpendicular to a longitudinal direction of the conductor bundles, an average value of values obtained by dividing the shortest distance from the center of each of the insulated conductors of the n conductor bundles to the surface of an adjacent non-insulated conductor by a distance from the center of the insulated conductor to the outermost surface of the insulated conductor is preferably in a range of 1 to 1.3.

In the multi-core cable according to the present invention, since an average value of values obtained by dividing the shortest distance from the center of each of the insulated conductors to the surface of an adjacent non-insulated conductor by a distance from the center of the insulated conductor to the outermost surface of the insulated conductor is in a range of 1 to 1.3, it is possible to prevent the occurrence of noise due to characteristic impedance mismatch and reduction in transmission performance due to an increase in reflected waves.

In addition, in the multi-core cable according to the present invention, for all of the n conductor bundles, the frequency of appearance of the same surface in cross sections perpendicular to a longitudinal direction of all of the conductor bundles is preferably 0.01 turns/m or less.

In the multi-core cable according to the present invention, for all of the n conductor bundles, since the frequency of appearance of the same surface in cross sections perpendicular to a longitudinal direction of all of the conductor bundles is 0.01 turns/m or less, and the same cross-sectional shape does not appear over 100 m or longer, it is possible to reduce far-end crosstalk by changing capacitive coupling between the insulated conductors in a longitudinal direction of all of the conductor bundles.

Moreover, in the multi-core cable according to the present invention, a combined resistance when the insulated conductors of the n conductor bundles are connected in parallel is preferably higher than a combined resistance when the non-insulated conductors of the n conductor bundles are connected in parallel.

In the multi-core cable according to the present invention, when a combined resistance when the insulated conductors are connected in parallel is set to be higher than a combined resistance when the non-insulated conductors are connected in parallel, the non-insulated conductor can function as a signal line and an increase in noise can be prevented.

In addition, the multi-core cable according to the present invention includes n conductor bundles. The n conductor bundles each include at least one insulated conductor and at least one non-insulated conductor. The at least one insulated conductor and the at least one non-insulated conductor are twisted T(N) (N=1 to n) times per unit length. The n conductor bundles are twisted T1 times per unit length. At least one T(N) (N=1 to n) is different from the others. The ratio between the number of insulated conductors and the number of non-insulated conductors in each of the n conductor bundles is in a range of 2:3 to 4:1. A non-insulated conductor paired with an insulated conductor is not fixed. Each of the insulated conductors is paired with a non-insulated conductor of the same conductor bundle and/or a non-insulated conductor of a different conductor bundle.

In the multi-core cable according to the present invention, at least one of a number of twists per unit length of the insulated conductor and the non-insulator is different from that of other conductor bundles. Therefore, it is possible to reduce far-end crosstalk by changing capacitive coupling between the insulated conductors in a longitudinal direction. In addition, in the multi-core cable according to the present invention, the ratio between the number of insulated conductors and the number of non-insulated conductors in each conductor bundle is set to be in a range of 2:3 to 4:1. Therefore, it is possible to reduce variation in electrostatic capacity of the insulated conductors.

In addition, a method of producing a multi-core cable includes twisting n conductor bundles each including at least one insulated conductor and at least one non-insulated conductor in which the at least one insulated conductor and the at least one non-insulated conductor are in a longitudinal direction of the conductor bundles T(N) (N=1 to n) times per unit length, and twisting the twisted n conductor bundles as a collected conductor group in a longitudinal direction of the conductor group T1 times per unit length. The ratio between the number of insulated conductors and the number of non-insulated conductors in each of the n conductor bundles is in a range of 2:3 to 4:1. A non-insulated conductor paired with an insulated conductor is not fixed, and each of the insulated conductors is paired with a non-insulated conductor of the same conductor bundle and/or a non-insulated conductor of a different conductor bundle.

In the method of producing a multi-core cable according to the present invention, n conductor bundles in which the insulated conductor and the non-insulator are twisted in a longitudinal direction of the conductor bundle according to a number of twists per unit length are prepared. Twisting is performed such that at least one of the number of twists per unit length of the conductor bundles is different from the others. Therefore, it is possible to reduce far-end crosstalk by changing capacitive coupling between the insulated conductors in a longitudinal direction. In addition, in the multi-core cable according to the present invention, the ratio between the number of insulated conductors and the number of non-insulated conductors in each conductor bundle is set to be in a range of 2:3 to 4:1. Therefore, it is possible to reduce variation in electrostatic capacity of the insulated conductors.

Advantageous Effects of Invention

According to the present invention, it is possible to provide a multi-core cable through which positions of a plurality of insulated conductors and a plurality of non-insulated conductors in a cross section in a longitudinal direction are changed randomly and a likelihood of transmission performance being reduced is low.

BRIEF DESCRIPTION OF DRAWINGS

FIG. 2(*a*) is an example in which the ratio between the number of insulated conductors and the number of non-insulated conductors is 1:1. FIG. 2(*b*) is an example in which the ratio between the number of insulated conductors and the number of non-insulated conductors is 2:1. FIG. 2(*c*) is an example in which the ratio between the number of insulated conductors and the number of non-insulated conductors is 4:1. FIG. 2(*d*) is an example in which the ratio between the number of insulated conductors and the number of non-insulated conductors is 2:3.

FIG. 3(*a*) is a side view of the first conductor bundle. FIG. 3(*b*) is a side view of the second conductor bundle. FIG. 3(*c*) is a side view of the third conductor bundle. FIG. 3(*d*) is a side view of the fourth conductor bundle.

FIG. 10(*b*) is a third diagram describing processes of determining a "frequency of appearance of the same surface in cross sections perpendicular to a longitudinal direction."

FIG. 13(*b*) is a third diagram describing processes of determining a "frequency of appearance of the same surface in cross sections perpendicular to a longitudinal direction."

DESCRIPTION OF EMBODIMENTS

A multi-core cable and a production method therefor according to the present invention will be described below with reference to the drawings. However, the scope of the present invention is not limited to such embodiments and encompasses equivalents within the scope of the appended claims.

(Overview of Multi-Core Cable According to the Present Invention)

A multi-core cable according to the present invention includes n conductor bundles whose ratios between the number of insulated conductors and the number of non-insulated conductors are in a range of 2:3 to 4:1. Here, at least one of the n conductor bundles differs from the other (n−1) conductor bundles in that a frequency at which cross sections perpendicular to a longitudinal direction of conductor bundles have the same shape is different. In such a configuration, conductor bundles forming a cable are set such that non-insulated conductors are always adjacent and close to insulated conductors. In addition, since at least one of the n conductor bundles differs from the other (n−1) conductor bundles in that a frequency at which cross sections perpendicular to a longitudinal direction of all n conductor bundles have the same shape is different, a frequency of appearance of the same cross section within a predetermined length in a longitudinal direction of a cable is lower compared to a cable including conductor bundles whose frequencies at which cross sections of such conductor bundle have the same shape are the same. In this manner, in the multi-core cable according to the present invention, positions of a plurality of insulated conductors and a plurality of non-insulated conductors in a cross section in a longitudinal direction are changed randomly and a likelihood of transmission performance being reduced is low.

In addition, in the multi-core cable according to the present invention, a non-insulated conductor paired with an insulated conductor is not fixed. That is, an insulated conductor and a non-insulated conductor may be paired in the same bundle, and an insulated conductor and a non-insulated conductor which are in adjacent different conductor bundles may be paired. For such reasons, the state is random beyond an apparent structure, and a crosstalk reduction effect is enhanced. Moreover, even in a configuration including a plurality of insulated conductors and fewer number of non-insulated conductors than the insulated conductors, a non-insulated conductor is always arranged close to an insulated conductor not only in a conductor bundle but also in the entire cable. Therefore, an effect enabling variation to be reduced in electrostatic capacity is further enhanced.

(Configuration of Multi-Core Cable According to Embodiment)

Figure 1:
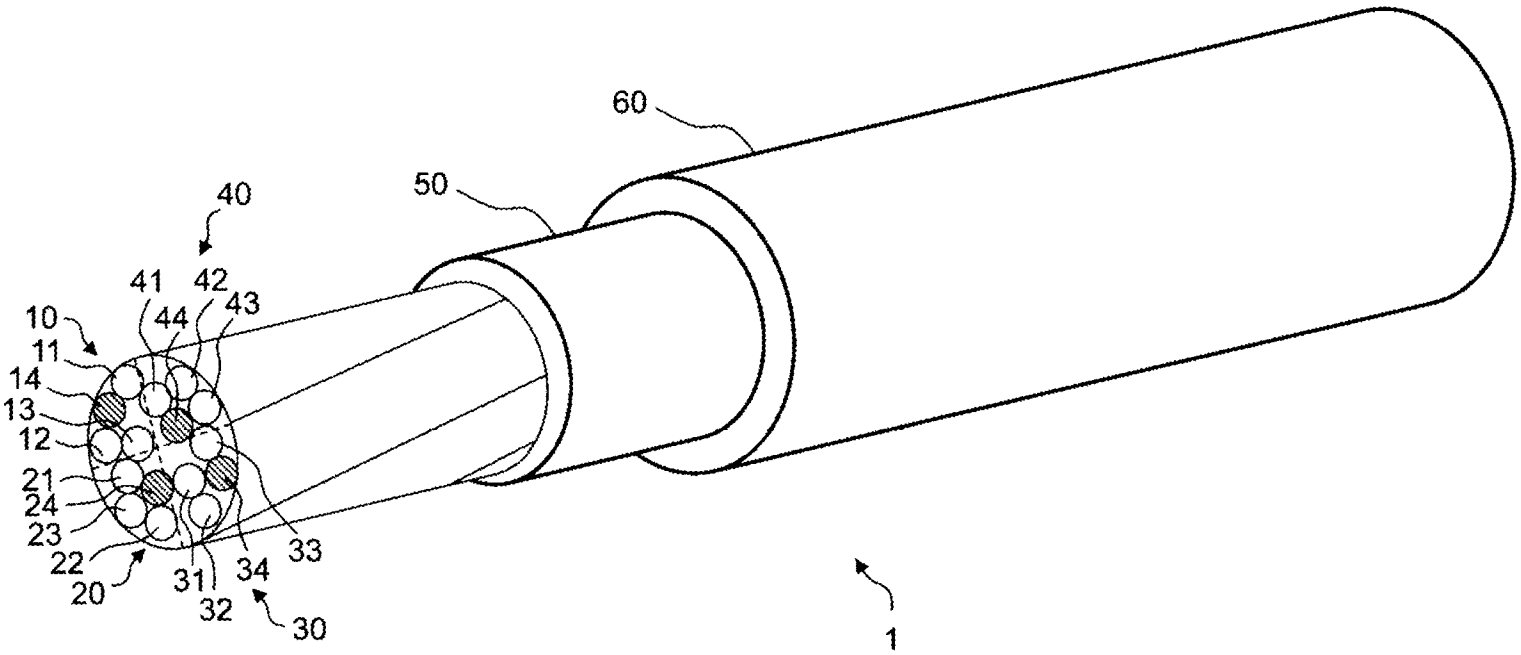
FIG. 1 is an exploded perspective view of a multi-core cable according to an embodiment.
Figure 2A:
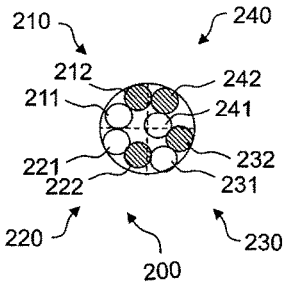
FIGS. 2(*a*), 2(*b*), 2(*c*), and 2(*d*) show diagrams of exemplary cross sections perpendicular to a longitudinal direction of conductor groups of multi-core cables whose ratios between the number of insulated conductors and the number of non-insulated conductors are 1:1 to 4:1.
Figure 2B:
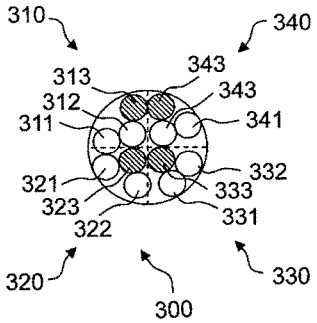
Figure 2C:
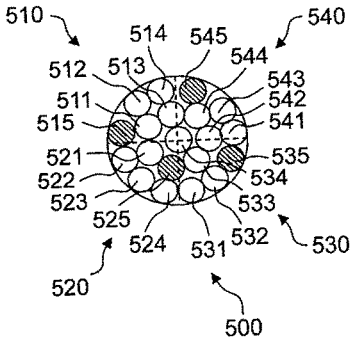
Figure 2D:
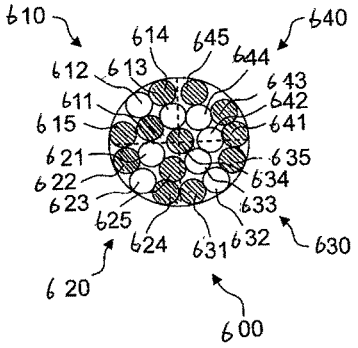
Figure 3A:
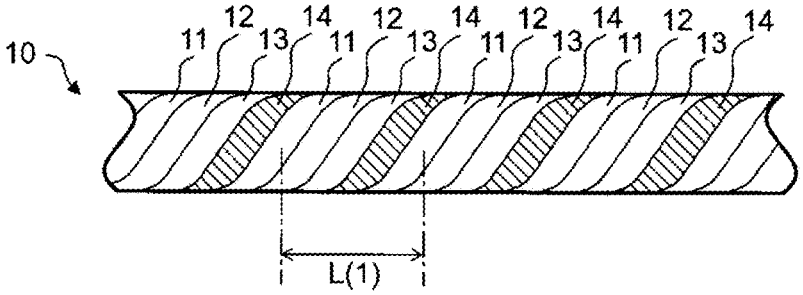
FIGS. 3(*a*), 3(*b*), 3(*c*), and 3(*d*) show side views of a first conductor bundle, a second conductor bundle, a third conductor bundle and a fourth conductor bundle shown in FIG. 1 which have not yet been twisted with another conductor bundle.
Figure 3B:
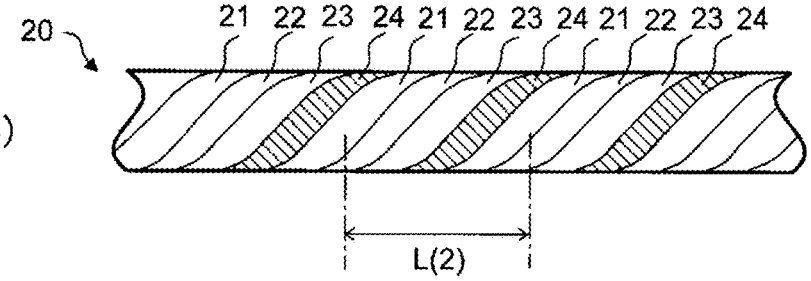
Figure 3C:
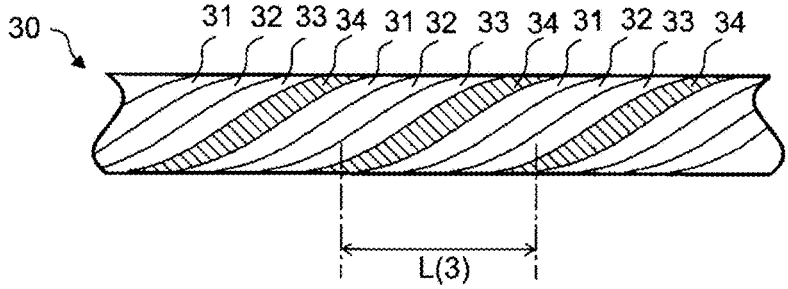
Figure 3D:
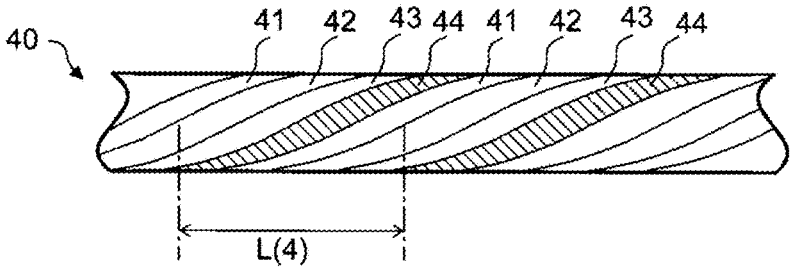

FIG. 1 is an exploded perspective view of a multi-core cable according to an embodiment.

A multi-core cable 1 includes a first conductor bundle 10, a second conductor bundle 20, a third conductor bundle 30, a fourth conductor bundle 40, an external shield 50, and a sheath 60. The first conductor bundle 10 includes an eleventh insulated conductor 11, a twelfth insulated conductor 12, a thirteenth insulated conductor 13, and a first non-insulated conductor 14. The second conductor bundle 20 includes a 21st insulated conductor 21, a 22nd insulated conductor 22, a 23rd insulated conductor 23, and a second non-insulated conductor 24. The third conductor bundle 30 includes a 31st insulated conductor 31, a 32nd insulated conductor 32, a 33rd insulated conductor 33, and a third non-insulated conductor 34. The fourth conductor bundle 40 includes a 41st insulated conductor 41, a 42nd insulated conductor 42, a 43rd insulated conductor 43, and a fourth non-insulated conductor 44. Here, in the multi-core cable 1, the first conductor bundle 10, the second conductor bundle 20, the third conductor bundle 30, and the fourth conductor bundle 40 each have three insulated conductors and one non-insulated conductor. However, in the multi-core cable according to the present invention, the ratio between the number of insulated conductors and the number of non-insulated conductors may be in a range of 2:3 to 4:1. In addition, in the multi-core cable according to the present invention, the total number of insulated conductors and non-insulated conductors included in each conductor bundle is preferably 10 or less so that an average value of values obtained by dividing the shortest distance from the center of each of the insulated conductors to the surface of an adjacent non-insulated conductor by a distance from the center of the insulated conductor to the outermost surface of the insulated conductor is in a range of 1 to 1.3. Since in a conductor bundle including one insulated conductor and one non-insulated conductor, although the number of signal lines is small, the diameter of the entire cable becomes too large, the total number of insulated conductors and non-insulated conductors included in each conductor bundle is preferably 3 or more.

FIG. 2 shows diagrams of exemplary cross sections perpendicular to a longitudinal direction of multi-core cable conductors whose ratio between the number of insulated conductors and the number of non-insulated conductors is 2:3 to 4:1. FIG. 2(*a*) is an example in which the ratio between the number of insulated conductors and the number of non-insulated conductors is 1:1. FIG. 2(*b*) is an example in which the ratio between the number of insulated conductors and the number of non-insulated conductors is 2:1. FIG. 2(*c*) is an example in which the ratio between the number of insulated conductors and the number of non-insulated conductors is 4:1. FIG. 2(*d*) is an example in which the ratio between the number of insulated conductors and the number of non-insulated conductors is 2:3. In FIGS. 2(*a*) to 2(*d*), dashed lines conceptually indicate areas of conductor bundles.

A conductor portion (hereinafter referred to as a "core") 200 of a cable whose ratio between the number of insulated conductors and the number of non-insulated conductors is 1:1 includes a first conductor bundle 210 to a fourth conductor bundle 240. An insulated conductor 211 of the first conductor bundle 210 to an insulated conductor 241 of the fourth conductor bundle 240 are each arranged close to any of a non-insulated conductor 212 of the first conductor bundle 210 to a non-insulated conductor 242 of the fourth conductor bundle 240.

A core 300 whose ratio between the number of insulated conductors and the number of non-insulated conductors is 2:1 includes a first conductor bundle 310 to a fourth conductor bundle 340. Insulated conductors 311 and 312 of the first conductor bundle 310 to insulated conductors 341 and 342 of the fourth conductor bundle 340 are each arranged close to any of a non-insulated conductor 313 of the first conductor bundle 310 to a non-insulated conductor 343 of the fourth conductor bundle 340.

A core 500 whose ratio between the number of insulated conductors and the number of non-insulated conductors is 4:1 includes a first conductor bundle 510 to a fourth conductor bundle 540. Insulated conductors 511 to 514, 521 to 524, 531 to 534, and 541 to 544 (except the insulated conductor 542) of the conductor portion 500 are arranged close to any of a non-insulated conductor 515 of the first conductor bundle 510 to a non-insulated conductor 545 of the fourth conductor bundle 540. The insulated conductor 542 is far from the non-insulated conductor 545 of the same fourth conductor bundle 540 but is close to a non-insulated conductor 535 of the third conductor bundle 530 that is different from the fourth conductor bundle 540. Therefore, in the conductor portion 500, an average value of distances between each of the insulated conductors and the non-insulated conductor is 1.3 times the diameter of the non-insulated conductor or less. Also, here, for the term "an average value of distances between each of the insulated conductors and the non-insulated conductor," a plurality of cross sections perpendicular to a longitudinal direction of the multi-core cable 1 are sampled, and "a value obtained by dividing the shortest distance from the center of each of the insulated conductors of the conductor bundles to the surface of an adjacent non-insulated conductor by a distance from the center of the insulated conductor to the outermost surface of the insulated conductor" in a relationship between the insulated conductors and the non-insulated conductors in each of the cross sections is set as an average value of measured values at a plurality of locations (the same hereinafter). As an example, the number of cross sections sampled is 5, and the number of "values obtained by dividing the shortest distance from the center of each of the insulated conductors of the conductor bundles to the surface of an adjacent non-insulated conductor by a distance from the center of the insulated conductor to the outermost surface of the insulated conductor" measured in one cross section is 12 (the cross section is radially divided into 12 equal spaces and one value is assigned in each of the equal spaces after division).

A core 600 whose ratio between the number of insulated conductors and the number of non-insulated conductors is 2:3 includes a first conductor bundle 610 to a fourth conductor bundle 640. Insulated conductors 612, 613, 621, 623, 632, 633, 642 and 644 of the core 600 are arranged close to any of non-insulated conductors 611, 614, 615, 622, 624, 625, 631, 634, 635, 641, 643, and 645. Therefore, in the core 600, an average value of distances between each of the insulated conductors and the non-insulated conductor is 1.3 times the diameter of the non-insulated conductor or less.

In FIG. 1, the first conductor bundle 10, the second conductor bundle 20, the third conductor bundle 30, and the fourth conductor bundle 40 are each twisted in a left direction T(1), T(2), T(3), and T(4) times per unit length in a longitudinal direction of the conductor bundle. As an example, a twist pitch L1 at which the first conductor bundle 10, the second conductor bundle 20, the third conductor bundle 30, and the fourth conductor bundle 40 are twisted together is 60 mm. In this case, twist pitches of the first conductor bundle 10, the second conductor bundle 20, the third conductor bundle 30, and the fourth conductor bundle 40 are, for example, 4 mm, 6 mm, 7 mm, and 9 mm.

The insulated conductors of the first conductor bundle 10, the second conductor bundle 20, the third conductor bundle 30, and the fourth conductor bundle 40 each include a core material formed of a silver-plated and tin-containing copper alloy and a coating layer that is formed of polytetrafluoroethylene (PFA) and is arranged around the core material. The insulated conductors of the first conductor bundle 10, the second conductor bundle 20, the third conductor bundle 30, and the fourth conductor bundle 40 function as signal lines for transmitting a signal. The diameters of the insulated conductors of the first conductor bundle 10, the second conductor bundle 20, the third conductor bundle 30, and the fourth conductor bundle 40 are the same. In addition, the diameters of the core materials of the insulated conductors of the first conductor bundle 10, the second conductor bundle 20, the third conductor bundle 30, and the fourth conductor bundle 40 are the same.

The non-insulated conductors of the first conductor bundle 10, the second conductor bundle 20, the third conductor bundle 30, and the fourth conductor bundle 40 are formed of a silver-plated and tin-containing copper alloy in the same manner as in the core material of the insulated conductor. The non-insulated conductors of the first conductor bundle 10, the second conductor bundle 20, the third conductor bundle 30, and the fourth conductor bundle 40 are grounded and function as drain lines. The diameters of the non-insulated conductors of the first conductor bundle 10, the second conductor bundle 20, the third conductor bundle 30, and the fourth conductor bundle 40 are the same and are larger than the diameters of the core materials of the insulated conductors of the first conductor bundle 10, the second conductor bundle 20, the third conductor bundle 30, and the fourth conductor bundle 40.

FIG. 3 shows side views of the first conductor bundle 10, the second conductor bundle 20, the third conductor bundle 30, and the fourth conductor bundle 40 which have not yet been twisted with another conductor bundle. FIG. 3(*a*) is a side view of the first conductor bundle 10. FIG. 3(*b*) is a side view of the second conductor bundle 20. FIG. 3(*c*) is a side view of the third conductor bundle 30. FIG. 3(*d*) is a side view of the fourth conductor bundle 40.

The first conductor bundle 10 is formed by twisting a conductor bundle in which the eleventh insulated conductor 11, the twelfth insulated conductor 12, the thirteenth insulated conductor 13, and the first non-insulated conductor 14 are left-wound in that order in a longitudinal direction T(1) times per unit length. The second conductor bundle 20 is formed by twisting a conductor bundle in which the 21st insulated conductor 21, the 22nd insulated conductor 22, the 23rd insulated conductor 23, and the second non-insulated conductor 24 are left-wound in that order in a longitudinal direction T(2) times per unit length. The third conductor bundle 30 is formed by twisting a conductor bundle in which the 31st insulated conductor 31, the 32nd insulated conductor 32, the 33rd insulated conductor 33, and the third non-insulated conductor 34 are left-wound in that order in a longitudinal direction T(3) times per unit length. The fourth conductor bundle 40 is formed by twisting a conductor bundle in which the 41st insulated conductor 41, the 42nd insulated conductor 42, the 43rd insulated conductor 43, and the fourth non-insulated conductor 44 are left-wound in that order in a longitudinal direction T(4) times per unit length.

In the first conductor bundle 10, the frequency AF(1) of appearance of the same surface in cross sections perpendicular to a longitudinal direction is equal to the number of twists T(1) per unit length of the first conductor bundle 10. In the second conductor bundle 20, the frequency AF(2) of appearance of the same surface in cross sections perpendicular to a longitudinal direction is equal to the number of twists T(2) per unit length of the second conductor bundle 20. In addition, in the third conductor bundle 30, the frequency AF(3) of appearance of the same surface in cross sections perpendicular to a longitudinal direction is equal to the number of twists T(3) per unit length of the third conductor bundle 30. In the fourth conductor bundle 40, the frequency AF(4) of appearance of the same surface in cross sections perpendicular to a longitudinal direction is equal to the number of twists T(4) per unit length of the fourth conductor bundle 40.

As an example, a twist pitch L(1) of the first conductor bundle 10 is 4 mm, a twist pitch L(2) of the second conductor bundle 20 is 6 mm, a twist pitch L(3) of the third conductor bundle 30 is 7 mm, and a twist pitch L(4) of the fourth conductor bundle 40 is 9 mm. In the first conductor bundle 10 to the fourth conductor bundle 40, the number of twists T(1) to T(4) per unit length are defined as reciprocal numbers of the twist pitches L(1) to L(4) of the first conductor bundle 10 to the fourth conductor bundle 40. That is, when the twist pitch L(1) is 4 mm, the number of twists T(1) per unit length of the first conductor bundle 10 is 250 turns/m. When the twist pitch L(2) is 6 mm, the number of twists T(2) per unit length of the second conductor bundle 20 is 166 turns/m. In addition, when the twist pitch L(3) is 7 mm, the number of twists T(3) per unit length of the third conductor bundle 30 is 142 turns/m. When the twist pitch L(4) is 9 mm, the number of twists T(4) per unit length of the fourth conductor bundle 40 is 111 turns/m. In addition, in the first conductor bundle 10 to the fourth conductor bundle 40, the frequencies AF(1) to AF(4) of appearance of the same surface in cross sections perpendicular to a longitudinal direction in the conductor bundle are the same as the numbers of the number of twists T(1) to T(4) per unit length. Here, in order for cross sections perpendicular to a longitudinal direction to have the same surface, it is necessary for the cross sections to have the same phase in addition to the same positional relationship between the insulated conductors and the non-insulated conductors. In each of the first conductor bundle 10 to the fourth conductor bundle 40, since insulated conductors and a non-insulated conductor are twisted in a longitudinal direction of the conductor bundle at the same twist pitch, the positional relationship between the insulated conductors and the non-insulated conductor does not change in a longitudinal direction. However, in each of the first conductor bundle 10 to the fourth conductor bundle 40, cross sections perpendicular to a longitudinal direction gradually change in phase with a twist pitch over one cycle period. Therefore, here, although the positional relationship between the insulated conductors and the non-insulated conductors is the same, if phases of the cross sections do not match, the cross sections perpendicular to a longitudinal direction do not have the same surface.

Figure 4:
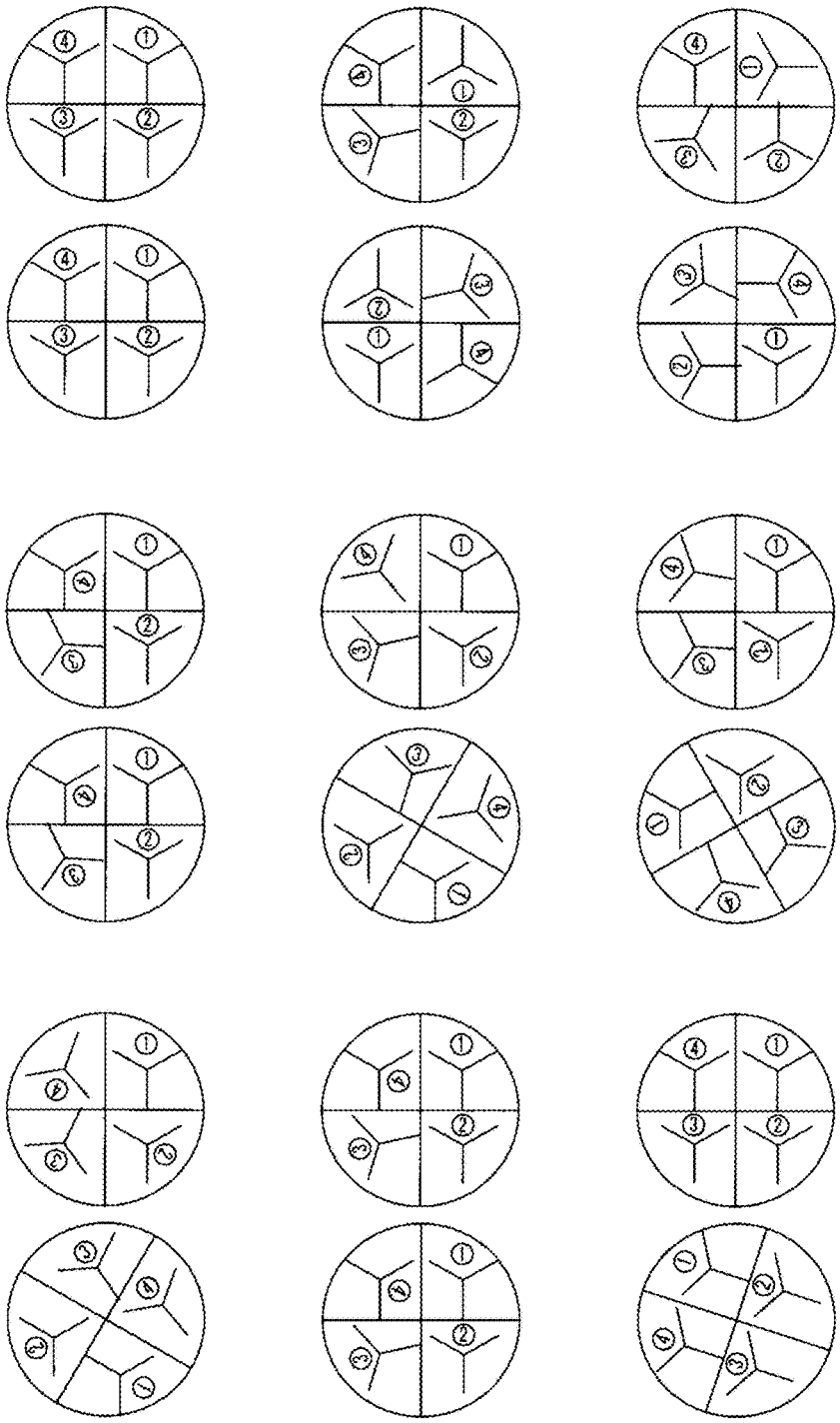
FIG. 4 shows diagrams of phase relationships of cross sections perpendicular to a longitudinal direction before and after the first conductor bundle to fourth conductor bundle shown in FIG. 1 are twisted together.

FIG. 4 conceptually shows the progress of phase relationships until the same cross section appears in the cross sections in a longitudinal direction while conductor bundles are twisted. In FIGS. 4(*a*) to 4(*i*), the upper parts show states before the first conductor bundle 10, the second conductor bundle 20, the third conductor bundle 30, and the fourth conductor bundle 40 are twisted together. The lower parts show states after the first conductor bundle 10, the second conductor bundle 20, the third conductor bundle 30, and the fourth conductor bundle 40 are twisted together. The twist pitches L(1) to L(4) of the first conductor bundle 10 to the fourth conductor bundle 40 are, for example, 4 mm, 6 mm, 7 mm, and 9 mm. In addition, the twist pitch L1 in a longitudinal direction of a conductor group in which the first conductor bundle 10, the second conductor bundle 20, the third conductor bundle 30, and the fourth conductor bundle 40 are twisted together is 60 mm. FIG. 4(*a*) shows a state in which phases of the first conductor bundle 10, the second conductor bundle 20, the third conductor bundle 30, and the fourth conductor bundle 40 match. FIGS. 4(*b*) to 4(*i*) show states at positions 30 mm, 45 mm, 60 mm, 100 mm, 200 mm, 220 mm, 240 mm, and 252 mm away from the position shown in FIG. 4(*a*). In FIGS. 4(*a*) to 4(*i*), circled numbers correspond to numbers of conductor bundles, and orientations of the circled numbers and a Y-shaped symbol (hereinafter referred to "Y") are changed in response to changes in phases of cross sections of conductor bundles. That is, the first conductor bundle 10 is indicated by a circle 1, the second conductor bundle 20 is indicated by a circle 2, the third conductor bundle 30 is indicated by a circle 3, and the fourth conductor bundle 40 is indicated by a circle 4. Here, the circle 1 to the circle 4 are notations in which a number of "1" to "4" is arranged inside a circle. In addition, in FIGS. 4(*a*) to 4(*i*), "Y" indicates phases of the first conductor bundle 10, the second conductor bundle 20, the third conductor bundle 30, and the fourth conductor bundle 40 in cross sections. When the circle 1 to the circle 4 are biased upward and "Y" is upright, the phase is "0." When the circle 1 to the circle 4 are biased to the right side and "Y" is tilted 90 degrees to the right, the phase is "π/2." In addition, when the circle 1 to the circle 4 is biased downward and "Y" is inverted, the phase is "π." When the circle 1 to circle 4 are biased to the left side and "Y" is tilted 90 degrees to the left, the phase is "3π/2."

As shown in the upper parts of FIGS. 4(*a*) to 4(*i*), since the twist pitches L(1) to L(4) of the first conductor bundle 10, the second conductor bundle 20, the third conductor bundle 30, and the fourth conductor bundle 40 are different from each other, the phases appearing in the cross sections are different. Until the length reaches 252 mm that is a length corresponding to the least common multiple of the twist pitches L(1) to L(4), a cross section in which all of the first conductor bundle 10, the second conductor bundle 20, the third conductor bundle 30, and the fourth conductor bundle 40 are in the same phase does not appear.

As shown in the lower parts in FIGS. 4(*a*) to 4(*i*), when the first conductor bundle 10, the second conductor bundle 20, the third conductor bundle 30, and the fourth conductor bundle 40 are twisted at the twist pitch L1, the phases appearing in the cross sections further change according to the twist pitch L1. That is, when twisting is performed at the twist pitch L1, until the length reaches 1260 mm that is the least common multiple of the twist pitches L(1) to L(4) and L1, a cross section in which all of the first conductor bundle 10, the second conductor bundle 20, the third conductor bundle 30, and the fourth conductor bundle 40 are in the same phase does not appear.

As shown in FIG. 1, the external shield 50 is formed by braiding a conductive wire formed of a tin-plated tin-containing copper alloy and is arranged to cover the outer circumferential surface of the first conductor bundle 10, the second conductor bundle 20, the third conductor bundle 30, and the fourth conductor bundle 40 which are twisted together using an EPTFE tape (not shown). The sheath 60 is a protective coating layer formed of polyvinyl chloride (PVC) and is arranged on the outer circumference of the external shield 50.

(Method of Producing Multi-Core Cable According to Embodiment)

Figure 5:
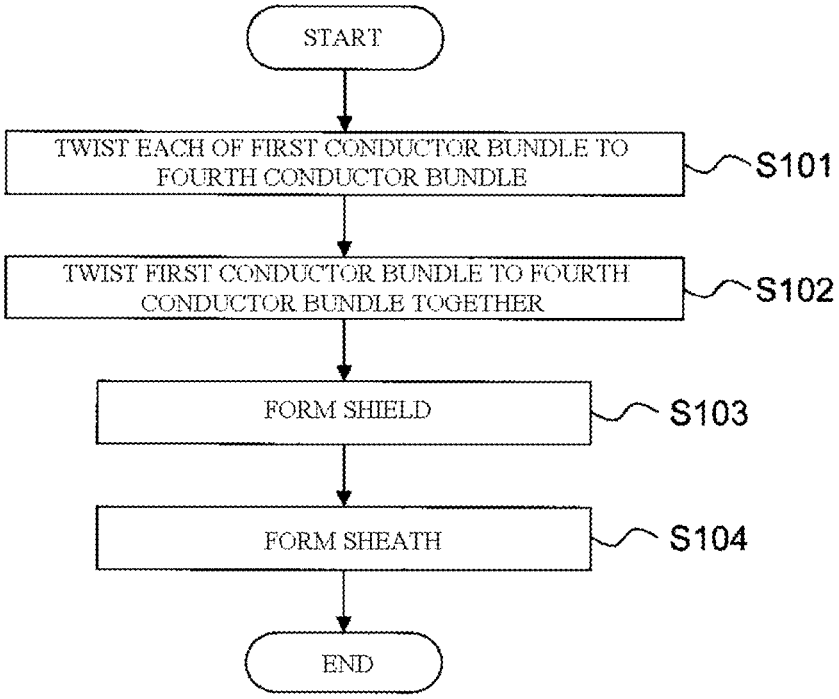
FIG. 5 is a flowchart showing processes of producing a multi-core cable according to an embodiment.
Figure 6:
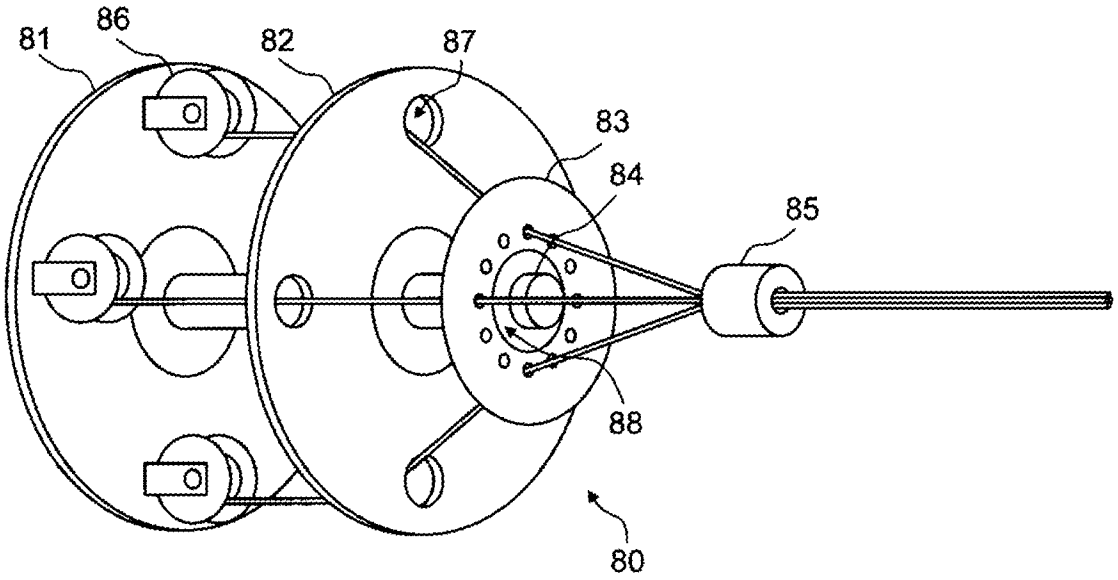
FIG. 6 is a diagram showing a twister used when each conductor bundle is twisted and conductor bundles are twisted together.
Figure 7:
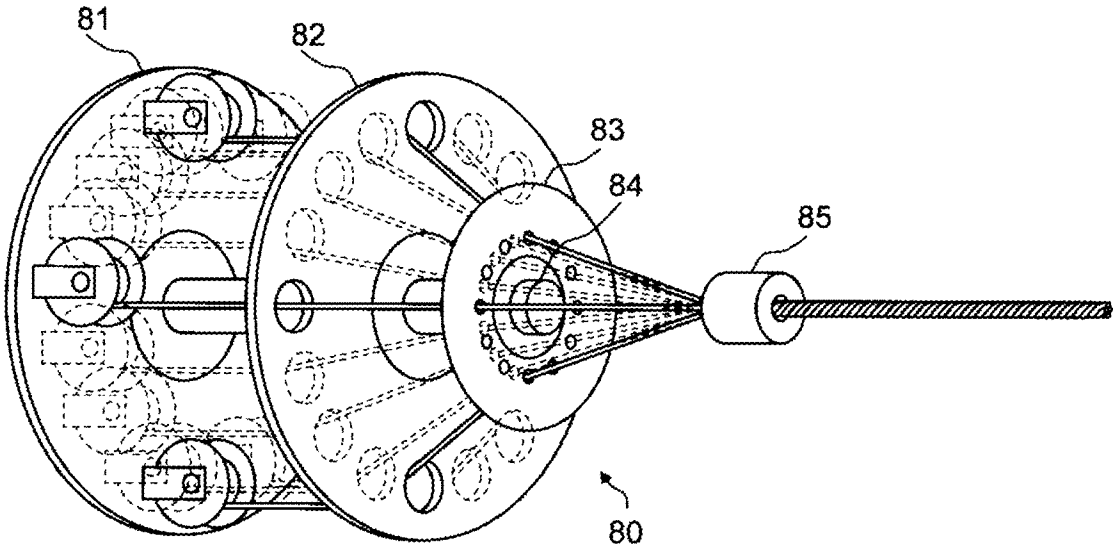
FIG. 7 is a diagram showing an operation state of the twister shown in FIG. 6.

FIG. 5 is a flowchart showing processes of producing the multi-core cable 1. FIG. 6 is a diagram showing a twister used when each of the first conductor bundle 10 to the fourth conductor bundle 40 is twisted and the first conductor bundle 10 to the fourth conductor bundle 40 are twisted together. In addition, FIG. 7 is a diagram showing an operation state of the twister shown in FIG. 6.

First, each of the first conductor bundle 10 to the fourth conductor bundle 40 is twisted (S101). Next, the first conductor bundle 10 to the fourth conductor bundle 40 twisted in S101 are twisted together to form a conductor group (S102). Here, the conductor group corresponds to all of n conductor bundles.

A twister 80 includes a first rotating plate 81, a second rotating plate 82, a third rotating plate 83, a rotary shaft 84, a throttle port 85, and the four unwinding devices 86 (only three are shown). The first rotating plate 81, the second rotating plate 82, and the third rotating plate 83 are rotatably arranged around the rotary shaft 84. The first rotating plate 81 rotatably supports the four unwinding devices 86 at positions shifted 90 degrees from each other on one surface. In the second rotating plate 82, four second cable through holes 87 are formed. In the third rotating plate 83, twelve third cable through holes 88 are formed. Each of the 12 third cable through holes 88 is formed at a position closer to the rotary shaft 84 than the second cable through holes 87. In the four unwinding devices 86, conductor bundles in which insulated conductors, non-insulated conductors, or insulated conductors and non-insulated conductors are twisted are wound. The tips of the conductors wound around the four unwinding devices 86 are arranged to penetrate the throttle port 85 through the second cable through holes 87 and the third cable through holes 88. When the first rotating plate 81, the second rotating plate 82, and the third rotating plate 83 are rotated at the same predetermined rotational speed and the tips of the conductors arranged to penetrate the throttle port 85 are moved in a horizontal direction at a predetermined speed, it is possible to twist, for example, four conductors, at a desired pitch.

When the first conductor bundle 10 is twisted, the eleventh insulated conductor 11, the twelfth insulated conductor 12, the thirteenth insulated conductor 13, and the first non-insulated conductor 14 are wound around the four unwinding devices 86, and the tips of the wound four conductors are arranged to penetrate the throttle port 85. Therefore, the first rotating plate 81, the second rotating plate 82, and the third rotating plate 83 are rotated at a predetermined rotational speed and the tips of the conductors are moved in a horizontal direction at a predetermined speed so that the twist pitch L(1) is 4 mm. In addition, when the first conductor bundle 10 to the fourth conductor bundle 40 are twisted together, the first conductor bundle 10 to the fourth conductor bundle 40 are wound around the four unwinding devices 86 and the tips of the wound four conductor bundles are arranged to penetrate the throttle port 85. Then, the first rotating plate 81, the second rotating plate 82, and the third rotating plate 83 are rotated at a predetermined rotational speed and the tip of the conductor bundle is moved in a horizontal direction at a predetermined speed.

Next, the external shield 50 is formed on the outer circumferential surface of the first conductor bundle 10, the second conductor bundle 20, the third conductor bundle 30, and the fourth conductor bundle 40 which are twisted together (S103). As an example, the external shield 50 is formed by braiding a conductive wire around the first conductor bundle 10, the second conductor bundle 20, the third conductor bundle 30, and the fourth conductor bundle 40 which are twisted together using an EPTFE tape. Then, the sheath 60 is formed on the outer circumferential surface of the external shield 50 (S104). As an example, the sheath 60 is formed by extruding melted PVC onto the outer circumferential surface of the external shield 50.

Here, the method of producing a multi-core cable described with reference to FIGS. 5 to 7 is an example of the method of producing the cable according to the present invention. The cable according to the present invention may be produced using other production methods. For example, for the cable according to the present invention, instead of the twister 80 in which the first rotating plate 81 to the third rotating plate 83 rotate, a twister in which a throttle port for receiving a cable that has been sent rotates may be used.

(Operations and Effects of Multi-Core Cable According to Embodiment)

In the multi-core cable according to the embodiment, when a plurality of conductor bundles twisted at different twist pitches are twisted together again and the insulated conductors are arranged randomly, it is possible to reduce a periodicity in the longitudinal direction and reduce far-end crosstalk. Far-end crosstalk occurs when signal lines are arranged in parallel in a longitudinal direction and a state in which capacitive coupling between the signal lines does not change is continuous. In the multi-core cable according to the embodiment, when the insulated conductors are arranged randomly, far-end crosstalk is reduced by changing capacitive coupling between the insulated conductors in a longitudinal direction. That is, in the multi-core cable according to the embodiment, since none of the conductor bundles are coated, when the conductor bundles are twisted together, they are twisted while interfering with one another. Therefore, cross sections perpendicular to a longitudinal direction of the multi-core cable according to the embodiment do not have the same shape until the length reaches a length corresponding to the least common multiple of the twist pitch of each of the conductor bundles, and the twist pitch when the conductor bundles are twisted together.

For example, when the multi-core cable according to the embodiment is used as an ultrasonic probe cable, the frequency is about several MHz to several 10 MHz, and the length of the cable is about 4 to 5 m. When the multi-core cable according to the embodiment is used under such conditions, a length corresponding to the least common multiple of the twist pitch of each of the conductor bundles and the twist pitch when the conductor bundles are twisted together may be about 5 to 10 m. However, the length corresponding to the least common multiple of the twist pitch of each of the conductor bundles, and the twist pitch when the conductor bundles are twisted together is preferably 100 m or longer. When the length corresponding to the least common multiple of the twist pitch of each of the conductor bundles, and the twist pitch when the conductor bundles are twisted together is set to 100 m or longer, the frequency at which cross sections perpendicular to a longitudinal direction of all of the n conductor bundles have the same shape can be 0.01 turns/m.

Here, the term "frequency of appearance of the same surface in cross sections perpendicular to a longitudinal direction" is defined based on the twist pitch of each of the conductor bundles and the twist pitch when the conductor bundles are twisted together, as will be described below. The frequency of appearance of the same surface in cross sections perpendicular to a longitudinal direction of each of the conductor bundles is defined as a reciprocal number of the twist pitch of each of the conductor bundles. For example, a "frequency at which cross sections perpendicular to a longitudinal direction have the same shape" of the first conductor bundle 10 in the multi-core cable 1 is 250 turns/m because the twist pitch L(1) of the first conductor bundle 10 is 4 mm. In addition, the frequency of appearance of the same surface in cross sections perpendicular to a longitudinal direction of all of n conductor bundles is defined as the reciprocal number of the length corresponding to the least common multiple of the twist pitch of each of the conductor bundles, and the twist pitch when the conductor bundles are twisted together.

In addition, in the multi-core cable according to the embodiment, since none of the conductor bundles are coated, due to the tension generated when the conductor bundles are twisted together, the insulated conductors and the non-insulated conductors included in the conductor bundles are arranged close to each other to fill gaps. When the insulated conductors and the non-insulated conductors included in the conductor bundles are arranged close to each other, since the sizes of the gaps formed in the multi-core cable are smaller, the diameter of the multi-core cable according to the embodiment is reduced.

In addition, in the multi-core cable according to the embodiment, each conductor bundle includes at least one insulated conductor and at least one non-insulated conductor. When each of the conductor bundles includes at least one insulated conductor and at least one non-insulated conductor, a minimum distance between each of the plurality of insulated conductors and each of the plurality of non-insulated conductors can be set to be shorter than a predetermined length. In the multi-core cable according to the embodiment, the ratio between the number of insulated conductors and the number of non-insulated conductors in each conductor bundle is preferably in a range of 2:3 to 4:1. When the ratio between the number of insulated conductors and the number of non-insulated conductors in each conductor bundle is set to be in a range of 2:3 to 4:1, it is possible to reduce variation in electrostatic capacity of the insulated conductors in the multi-core cable according to the embodiment. In the multi-core cable according to the embodiment, when the variation in electrostatic capacity of the insulated conductors is reduced, it is possible to prevent the occurrence of noise due to characteristic impedance mismatch and reduction in transmission performance due to an increase in reflected waves.

In addition, when the ratio between the number of insulated conductors and the number of non-insulated conductors is in a range of 2:3 or more and less than 1:1 and the ratio between an average value of diameters of the insulated conductors and an average value of diameters of the non-insulated conductors is set to be in a range of 1.2:1 or more and 4:1 or less, since the number of non-insulated conductors paired with the insulated conductor increases, it is possible to enhance a crosstalk reduction effect. Also, since the ratio between an average value of diameters of the insulated conductors and an average value of diameters of the non-insulated conductors is in a range of greater than 1:1 and 4:1 or less, compared to when the ratio between an average value of diameters of the insulated conductors and an average value of diameters of the non-insulated conductors is 1:1 or less, it is possible to set the outer diameter of all of the insulated conductors and non-insulated conductors to be smaller, and it is possible to reduce the diameter of the cable.

(Modification of Multi-Core Cable According to Embodiment)

The multi-core cable 1 includes four conductor bundles in which the first conductor bundle 10, the second conductor bundle 20, the third conductor bundle 30, and the fourth conductor bundle 40 are twisted together. However, the multi-core cable according to the embodiment may include a plurality of conductor bundles. That is, the multi-core cable according to the embodiment may include two or three conductor bundles which are twisted together or may include five or more conductor bundles which are twisted together. In addition, in the multi-core cable according to the embodiment, a plurality of conductor groups in which n conductor bundles are twisted together may be twisted together again to form the core of the multi-core cable. That is, the multi-core cable according to the embodiment may be a cable twisted over three or more levels.

In addition, in the multi-core cable 1, the first conductor bundle 10, the second conductor bundle 20, the third conductor bundle 30, and the fourth conductor bundle 40 are each formed by twisting three insulated conductors and one non-insulated conductor. However, in the multi-core cable according to the embodiment, a plurality of conductor bundles each include at least one insulated conductor and at least one non-insulated conductor and the ratio between the number of insulated conductors and the number of non-insulated conductors in each conductor bundle may be in a range of 2:3 to 4:1. In addition, in the multi-core cable according to the embodiment, the number of insulated conductors and the number of non-insulated conductors included in the conductor bundle may be different for each conductor bundle.

In addition, in the multi-core cable 1, the twist pitches L(1) to L(4) of the first conductor bundle 10 to the fourth conductor bundle 40 are 4 mm, 6 mm, 7 mm, and 9 mm. The twist pitch L1 when the first conductor bundle 10 to the fourth conductor bundle 40 are twisted together is 60 mm. However, in the multi-core cable according to the embodiment, at least one of the twist pitches L(N) (N=1 to n) of the n conductor bundles may be different from the others. On the other hand, if L(N) and L1 are set so that the least common multiple of the twist pitch L(N) (N=1 to n) of the n conductor bundles and the twist pitch L1 when the n conductor bundles are twisted together is larger, it is possible to arrange insulated conductors randomly over a longer distance. In addition, in the multi-core cable according to the embodiment, any of twist pitches L(N) (N=1 to n) of the n conductor bundles may be set to be changed in a lengthwise direction without a constant cycle period.

In addition, in the multi-core cable 1, in consideration of flexibility and durability, the twist direction of each of the conductor bundles and the twist direction in which the conductor bundles are twisted together are the same. However, in the multi-core cable according to the embodiment, the twist direction of some of the conductor bundles may be opposite to the twist direction of the other conductor bundles and the twist direction in which the conductor bundles are twisted together. In addition, in the multi-core cable according to the embodiment, some of the conductor bundles may not be twisted. When the twist direction of some of the conductor bundles may be opposite to the twist direction of the other conductor bundles and the twist direction in which the conductor bundle are twisted together, the twist pitch of the conductor bundles twisted in the opposite direction may be set to be a significantly larger than the twist pitch of the other conductor bundles. When the twist pitch of the conductor bundles twisted in the opposite direction is set as a significantly large pitch, if the conductor bundles are twisted together, the conductor bundles twisted in the opposite direction are twisted while interfering with the other conductor bundles. Therefore, like the insulated conductors of the other conductor bundles, in the insulated conductors of the conductor bundles twisted in the opposite direction, it is possible to reduce a periodicity in a longitudinal direction of distances between insulated conductors.

In addition, in the multi-core cable 1, the diameters of the non-insulated conductors of the first conductor bundle 10, the second conductor bundle 20, the third conductor bundle 30, and the fourth conductor bundle 40 are larger than the diameter of the core material of the insulated conductor. However, the diameter of the non-insulated conductor may be smaller than the diameter of the core material of the insulated conductor. However, in the multi-core cable according to the embodiment, a combined resistance of the non-insulated conductors is preferably higher than a combined resistance of the insulated conductors. Here, the combined resistance of the non-insulated conductor indicates a resistance value when the non-insulated conductors included in the multi-core cable having a predetermined length are connected in parallel. The combined resistance of the insulated conductors indicates a resistance value when the insulated conductors of the same multi-core cable as the cable of which the combined resistance of the non-insulated conductors is measured are connected in parallel.

(Method of Determining "Frequency of Appearance of Same Surface in Cross Sections Perpendicular to Longitudinal Direction")

Figure 8:
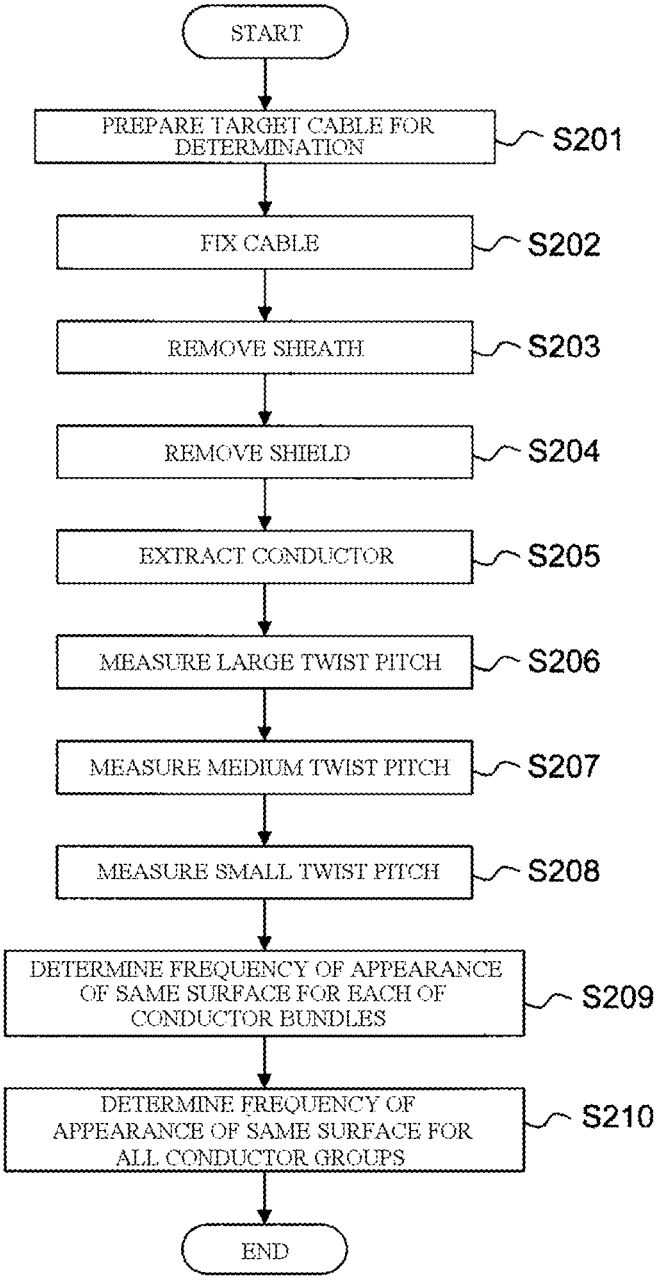
FIG. 8 is a flowchart showing processes of determining a "frequency of appearance of the same surface in cross sections perpendicular to a longitudinal direction."
Figure 9:
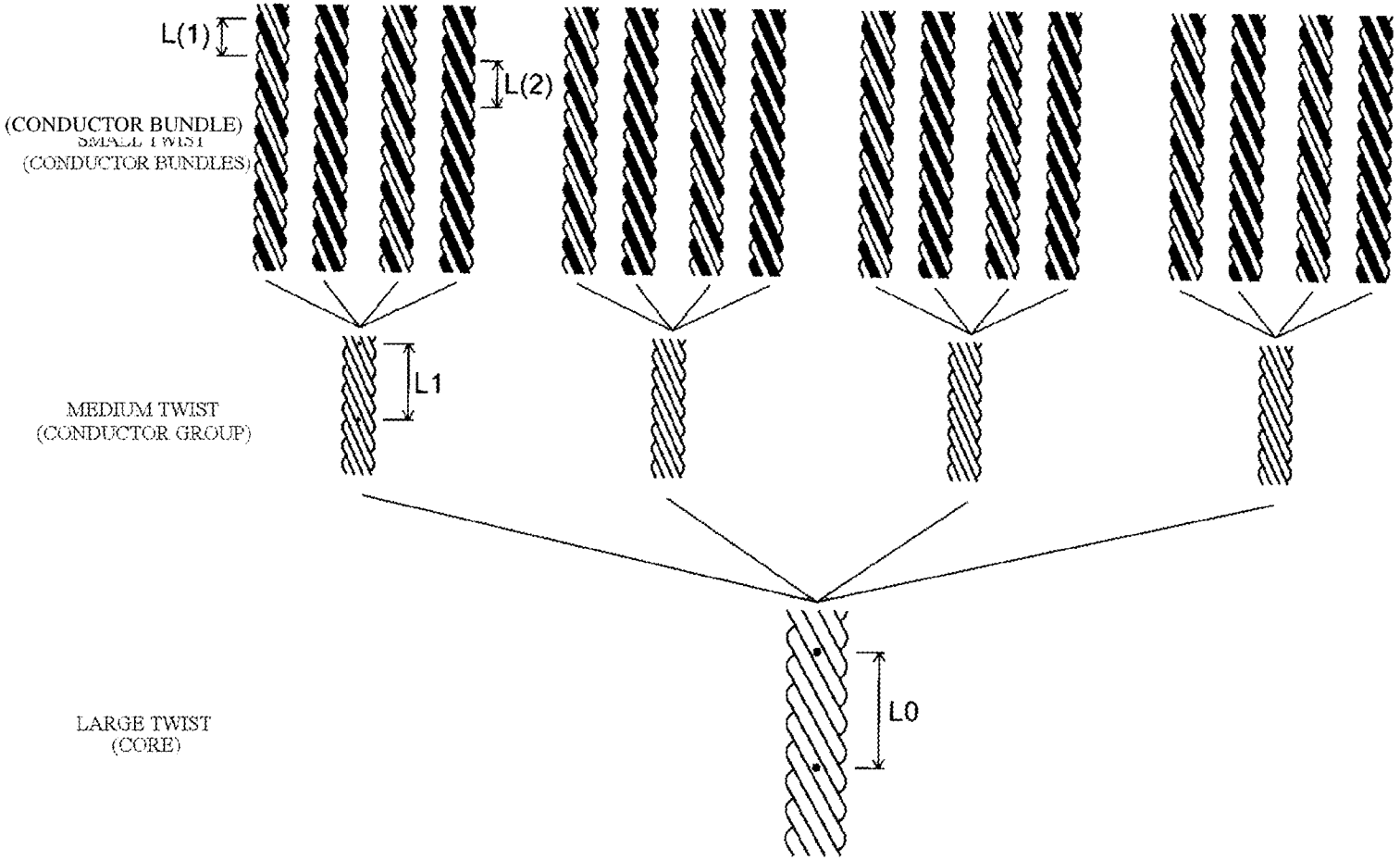
FIG. 9 is a first diagram describing processes of determining a "frequency of appearance of the same surface in cross sections perpendicular to a longitudinal direction."
Figure 10:
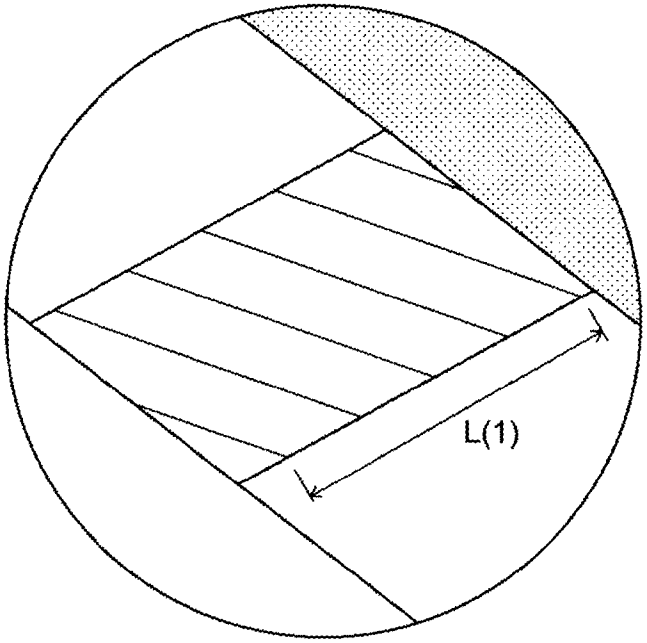
FIG. 10(*a*) is a second diagram describing processes of determining a "frequency of appearance of the same surface in cross sections perpendicular to a longitudinal direction."
Figure 10:
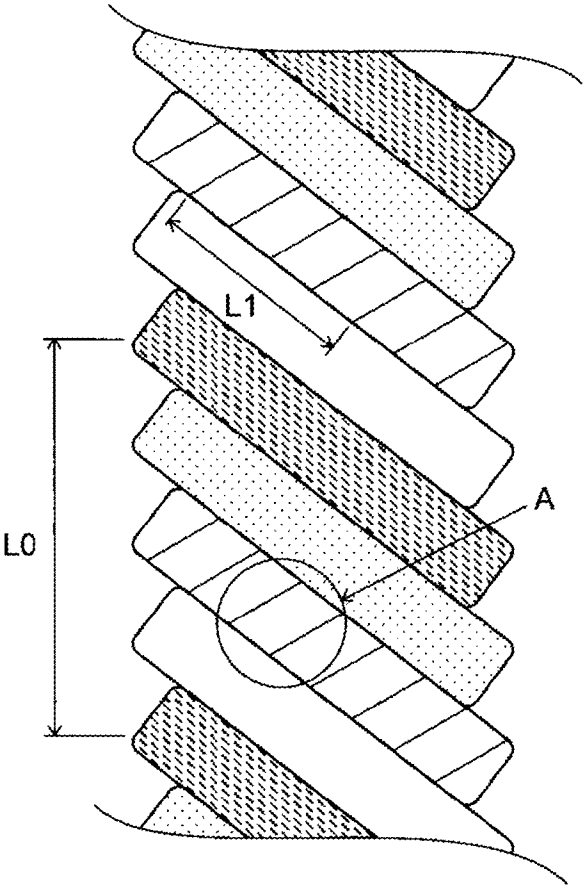

FIG. 8 is a flowchart showing processes of determining a "frequency of appearance of the same surface in cross sections perpendicular to a longitudinal direction." FIG. 9, and FIGS. 10(*a*) and 10(*b*) are diagrams showing processes of determining a "frequency of appearance of the same surface in cross sections perpendicular to a longitudinal direction." In FIG. 10(*a*), the same conductor bundles have the same hatching. FIG. 10(*b*) is an enlarged view of a part surrounded by a circle indicated by an arrow A in FIG. 10(*a*).

As shown in FIG. 8, first, an operator prepares a cable used to determine a "frequency of appearance of the same surface in cross sections perpendicular to a longitudinal direction" (S201). The cable is fixed so that at least a part of the cable extends in a horizontal direction to a desired distance (S202). Next, the operator removes the sheath of the cable (S203), and then removes the external shield (S204). Therefore, the core of the cable is extracted (S205). Here, as the core used to determine a "frequency of appearance of the same surface in cross sections perpendicular to a longitudinal direction," a core that is twisted over 3 levels will be described. That is, as shown in FIG. 9, the core formed by twisting over 3 levels is formed such that four conductor bundles in which insulated conductors and non-insulated conductors are slightly twisted at small twist pitches L(1) or L(2) are moderately twisted at the medium twist pitches L1, and the collected four conductor groups are greatly twisted at large twist pitches L0. The twister 80 shown in FIG. 6 is used when the slightly twisted conductor bundles are formed, when the moderately twisted conductor group is formed, and when the greatly twisted core is formed.

Next, the operator measures the large twist pitch L0 when the four conductor groups are greatly twisted (S206). The large twist pitch L0 is obtained by measuring the interval at which the same conductor group appears in a longitudinal direction of the core extracted in S205. Here, since the length of the large twist pitch L0 may differ for each position of the core, the interval at which the same conductor group appears is measured for a plurality of conductor groups at a plurality of positions and an average value of the measured values is preferably set as the large twist pitch L0.

Next, the operator measures the medium twist pitch L1 when four conductor bundles are moderately twisted (S207). The medium twist pitch L1 is obtained by measuring the interval at which the same conductor bundle appears in a winding direction of a conductor group in which the moderately twisted conductor groups are greatly twisted. Also, since the length of the medium twist pitch L1 may differ for each position of the core, the interval at which the same conductor bundle appears is measured at a plurality of positions for each conductor group, and an average value of the measured values is preferably set as the medium twist pitch L1.

Next, the operator measures small twist pitches L(1) and L(2) when the four conductors are slightly twisted (S208). The small twist pitches L(1) and L(2) are obtained by measuring the interval at which the same insulated conductor or non-insulated conductor appears in a longitudinal direction of the conductor bundle. Here, since the lengths of the small twist pitches L(1) and L(2) may differ for each position of the conductor, the interval at which the same insulated conductor or non-insulated conductor appears is measured at a plurality of positions for each conductor bundle, and average values of the measured values are preferably set as the small twist pitches L(1) and L(2).

Next, the operator determines a frequency of appearance of the same surface in cross sections perpendicular to a longitudinal direction for each conductor bundle (S209). The operator determines reciprocal numbers of the small twist pitches L(1) and L(2) measured in S208 as frequencies of appearance of the same surface in cross sections perpendicular to a longitudinal direction. The frequency of appearance of the same surface in cross sections perpendicular to a longitudinal direction of the conductor bundle whose small twist pitch is measured as L(1) in S208 is the reciprocal number of the small twist pitch L(1). The frequency of appearance of the same surface in cross sections perpendicular to a longitudinal direction of the conductor bundle whose small twist pitch is measured as L(2) in S208 is the reciprocal number of the small twist pitch L(2).

Then, the operator determines a frequency of appearance of the same surface in cross sections perpendicular to a longitudinal direction for all conductor groups formed of the four conductor bundles (S210). The operator determines reciprocal numbers of the least common multiple of the medium twist pitch L1 measured in S207 and the small twist pitches L(1) and L(2) measured in S208 as frequencies of appearance of the same surface in cross sections perpendicular to a longitudinal direction for all four conductors.

Example 1

Next, crosstalks of eight cables of a comparative example, a first example, a second example, a third example, a fourth example, a fifth example, a sixth example, and a seventh example were compared. Cores thereof were formed in three levels of four conductor bundles, four conductor groups, and a core. For the cables, in the comparative example and the first example, four conductor bundles were each formed by small-twisting four insulated conductors and one non-insulated conductor. In the second example, four conductor bundles were each formed by small-twisting four insulated conductors and two non-insulated conductors. In the third and sixth examples, four conductor bundles were each formed by small-twisting two insulated conductors and three non-insulated conductors. In the fourth, fifth, and seventh examples, four conductor bundles were each formed by small-twisting four insulated conductors and six non-insulated conductors.

In addition, the four conductor groups were each formed by medium-twisting the four conductor bundles. Also, the cores of the cables twisted over three levels were each formed by large-twisting the four conductor groups. In three cables of the comparative example, the first example, the second example, and the third example, a core material of the insulated conductor had a size of 42AWG (7 twists, an outer diameter of 0.075 mm) and was insulated and coated to a thickness of 0.0225 mm, and the non-insulated conductor had a size of 38AWG (an outer diameter of 0.12 mm). In the fourth and sixth examples, a core material of the insulated conductor had a size of 42AWG (7 twists, an outer diameter of 0.075 mm) and was insulated and coated to a thickness of 0.0225 mm, and the non-insulated conductor had a size of 42AWG (an outer diameter of 0.075 mm). In the fifth example, a core material of the insulated conductor had a size of 44AWG (7 twists, an outer diameter of 0.06 mm) and was insulated and coated to a thickness of 0.03 mm, and the non-insulated conductor had a size of 44AWG (an outer diameter of 0.06 mm). In the seventh example, a core material of the insulated conductor had a size of 42AWG (7 twists, an outer diameter of 0.075 mm) and was insulated and coated to a thickness of 0.11 mm, and the non-insulated conductor had a size of 42AWG (an outer diameter of 0.075 mm).

In the comparative example and the first example, the conductor bundles each included four insulated conductors and one non-insulated conductor, and an average value of distances between each of the insulated conductors and the non-insulated conductor was 1.3 times the diameter of the non-insulated conductor or less. That is, in the comparative example and the first example, an average value of values obtained by dividing the shortest distance from the center of each of the insulated conductors to the surface of an adjacent non-insulated conductor by a distance from the center of the insulated conductor to the outermost surface of the insulated conductor was in a range of 1 to 1.3. In the second example, the conductor bundles each included four insulated conductors and two non-insulated conductors, and an average value of distances between each of the insulated conductors and the non-insulated conductor was 1.3 times the diameter of the non-insulated conductor or less. In the third and sixth examples, the conductor bundles each included two insulated conductors and three non-insulated conductors, and an average value of distances between each of the insulated conductors and the non-insulated conductor was 1.3 times the diameter of the non-insulated conductor or less. In the fourth, fifth, and seventh examples, the conductor bundles each included four insulated conductors and six non-insulated conductors, and an average value of distances between each of the insulated conductors and the non-insulated conductor was 1.3 times the diameter of the non-insulated conductor or less. That is, in the second, third, fourth, fifth, sixth, and seventh examples, an average value of values obtained by dividing the shortest distance from the center of each of the insulated conductors to the surface of an adjacent non-insulated conductor by a distance from the center of the insulated conductor to the outermost surface of the insulated conductor was in a range of 1 to 1.3. Twist pitches of the comparative example, the first example, the second example, the third example, the fourth example, and the fifth example are shown in Tables 1 to 5. In Tables 1 to 5, S represents the number of insulated conductors, and G represents the number of non-insulated conductors.

TABLE 1

[Comparative example]

| | Number of conductors (number) | | Twist pitch (mm) | | |
|---|---|---|---|---|---|
| | S | G | Small | Medium | Large |
| 1 | 4 | 1 | 10 | 25 | 80 |
| 2 | 4 | 1 | 10 | | |
| 3 | 4 | 1 | 10 | | |
| 4 | 4 | 1 | 10 | | |
| 5 | 4 | 1 | 10 | 25 | |
| 6 | 4 | 1 | 10 | | |
| 7 | 4 | 1 | 10 | | |
| 8 | 4 | 1 | 10 | | |
| 9 | 4 | 1 | 10 | 25 | |
| 10 | 4 | 1 | 10 | | |
| 11 | 4 | 1 | 10 | | |
| 12 | 4 | 1 | 10 | | |
| 13 | 4 | 1 | 10 | 25 | |
| 14 | 4 | 1 | 10 | | |
| 15 | 4 | 1 | 10 | | |
| 16 | 4 | 1 | 10 | | |

TABLE 2

[First example]

| | Number of conductors (number) | | Twist pitch (mm) | | |
|---|---|---|---|---|---|
| | S | G | Small | Medium | Large |
| 1 | 4 | 1 | 7 | 35 | 97 |
| 2 | 4 | 1 | 9 | | |
| 3 | 4 | 1 | 11 | | |
| 4 | 4 | 1 | 13 | | |
| 5 | 4 | 1 | 9 | 37 | |
| 6 | 4 | 1 | 13 | | |
| 7 | 4 | 1 | 17 | | |
| 8 | 4 | 1 | 19 | | |
| 9 | 4 | 1 | 11 | 41 | |
| 10 | 4 | 1 | 17 | | |
| 11 | 4 | 1 | 19 | | |
| 12 | 4 | 1 | 23 | | |
| 13 | 4 | 1 | 17 | 53 | |
| 14 | 4 | 1 | 23 | | |
| 15 | 4 | 1 | 29 | | |
| 16 | 4 | 1 | 31 | | |

TABLE 3

[Second example]

| | Number of conductors (number) | | Twist pitch (mm) | | |
|---|---|---|---|---|---|
| | S | G | Small | Medium | Large |
| 1 | 4 | 2 | 7 | 41 | 113 |
| 2 | 4 | 2 | 9 | | |
| 3 | 4 | 2 | 11 | | |
| 4 | 4 | 2 | 13 | | |
| 5 | 4 | 2 | 9 | 53 | |
| 6 | 4 | 2 | 13 | | |
| 7 | 4 | 2 | 17 | | |
| 8 | 4 | 2 | 19 | | |
| 9 | 4 | 2 | 11 | 67 | |
| 10 | 4 | 2 | 17 | | |
| 11 | 4 | 2 | 19 | | |
| 12 | 4 | 2 | 23 | | |
| 13 | 4 | 2 | 17 | 79 | |
| 14 | 4 | 2 | 23 | | |
| 15 | 4 | 2 | 29 | | |
| 16 | 4 | 2 | 31 | | |

TABLE 4

[Third example and sixth example]

| | Number of conductors (number) | | Twist pitch (mm) | | |
|---|---|---|---|---|---|
| | S | G | Small | Medium | Large |
| 1 | 2 | 3 | 7 | 41 | 113 |
| 2 | 2 | 3 | 9 | | |
| 3 | 2 | 3 | 11 | | |
| 4 | 2 | 3 | 13 | | |
| 5 | 2 | 3 | 9 | 53 | |
| 6 | 2 | 3 | 13 | | |
| 7 | 2 | 3 | 17 | | |
| 8 | 2 | 3 | 19 | | |
| 9 | 2 | 3 | 11 | 67 | |
| 10 | 2 | 3 | 17 | | |
| 11 | 2 | 3 | 19 | | |
| 12 | 2 | 3 | 23 | | |
| 13 | 2 | 3 | 17 | 79 | |
| 14 | 2 | 3 | 23 | | |
| 15 | 2 | 3 | 29 | | |
| 16 | 2 | 3 | 31 | | |

TABLE 5

[Fourth, fifth, and seventh examples]

| | Number of conductors (number) | | Twist pitch (mm) | | |
|---|---|---|---|---|---|
| | S | G | Small | Medium | Large |
| 1 | 4 | 6 | 7 | 41 | 113 |
| 2 | 4 | 6 | 9 | | |
| 3 | 4 | 6 | 11 | | |
| 4 | 4 | 6 | 13 | | |
| 5 | 4 | 6 | 9 | 53 | |
| 6 | 4 | 6 | 13 | | |
| 7 | 4 | 6 | 17 | | |
| 8 | 4 | 6 | 19 | | |
| 9 | 4 | 6 | 11 | 67 | |
| 10 | 4 | 6 | 17 | | |
| 11 | 4 | 6 | 19 | | |
| 12 | 4 | 6 | 23 | | |
| 13 | 4 | 6 | 17 | 79 | |
| 14 | 4 | 6 | 23 | | |
| 15 | 4 | 6 | 29 | | |
| 16 | 4 | 6 | 31 | | |

In the comparative example, the four conductor bundles were each formed at a small twist pitch of 10 mm, the four conductor groups were formed at a medium twist pitch of 25 mm, and the core was formed at a large twist pitch of 80 mm. Therefore, in the comparative example, in a longitudinal direction of the core, the same surface appeared in the cross section at about 400 mm that is the least common multiple of the pitches.

In the first example, as shown in Table 2, the four conductor bundles each had different small twist pitches L(1) to L(4) and were formed at small twist pitches at which a length corresponding to the least common multiple thereof was longer and a frequency of appearance of the same surface in cross sections perpendicular to a longitudinal direction was lower. In such a configuration, in a longitudinal direction of the core, the same surface appeared in the cross section at a value (mm) that exceeds 10 to the $17^{th}$ power that is the least common multiple of the pitches described in Table 2. As described above, in the first example, the least common multiple of the small twist pitches L(1) to L(4) and the medium twist pitch L1 was larger than that of the comparative example, and all of the four conductors were formed at medium twist pitches at which a frequency of appearance of the same surface in cross sections perpendicular to a longitudinal direction was lower. In addition, in the first example, the core was formed at a large twist pitch with a larger prime number than the medium twist pitch.

In the second example, as shown in Table 3, the four conductor bundles were formed at the same small twist pitches as in the first example. In addition, in the second example, twisting was performed at medium twist pitches with a larger prime number than the medium twist pitch L1 in the first example. Therefore, a frequency of appearance of the same surface in cross sections perpendicular to a longitudinal direction was lower in all of the four conductors. In addition, in the second example, the core was formed at a large twist pitch that was larger than the large twist pitch in the first example.

In the third to seventh examples, as shown in Table 4 and Table 5, the four conductor bundles were formed at the same small twist pitches as in the first example. In addition, in the third to seventh examples, twisting was performed at medium twist pitches with a larger prime number than the medium twist pitch L1 in the first example. Therefore, a frequency of appearance of the same surface in cross sections perpendicular to a longitudinal direction was lower in all of the four conductors. In addition, in the third to seventh examples, the core was formed at a large twist pitch that was larger than the large twist pitch in the first example.

Figure 11:
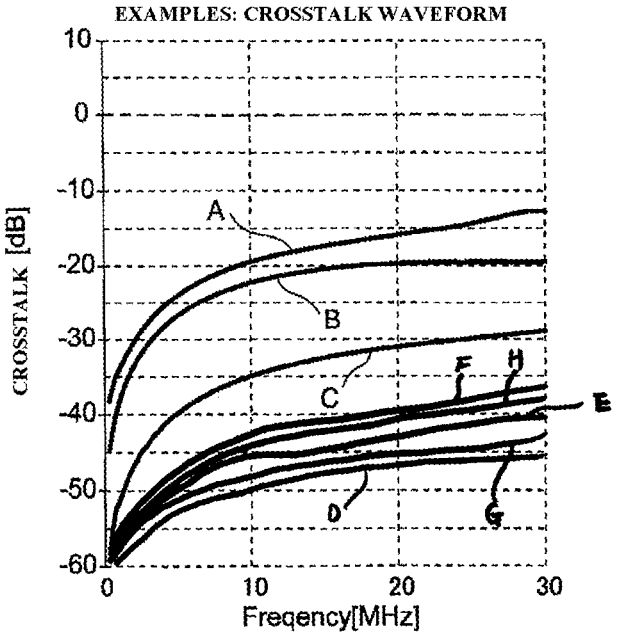
FIG. 11 shows graphs of frequency characteristics when crosstalk occurs in eight cables of a comparative example, a first example, a second example, a third example, a fourth example, a fifth example, a sixth example, and a seventh example.

FIG. 11 shows graphs of frequency characteristics when crosstalk occurred in eight cables of the comparative example, and the first to seventh examples. In FIG. 11, the horizontal axis represents a frequency (MHz) of a signal, and the vertical axis represents a magnitude (dB) of crosstalk. In addition, a graph indicated by an arrow A shows characteristics of the comparative example. A graph indicated by an arrow B shows characteristics of the first example. A graph indicated by an arrow C shows a characteristic of the second example. A graph indicated by an arrow D shows a characteristic of the third example. A graph indicated by an arrow E shows a characteristic of the fourth example. A graph indicated by an arrow F shows a characteristic of the fifth example. A graph indicated by an arrow G shows a characteristic of the sixth example. A graph indicated by an arrow H shows a characteristic of the seventh example.

Here, in the first to seventh examples, the outer diameter of all conductors in which the insulated conductors and the non-insulated conductor were twisted together was 1.95 mm in the first example, 2.1 mm in the second example, 1.6 mm in the third example, 2.1 mm in the fourth example, 1.8 mm in the fifth example, 1.5 mm in the sixth example, and 1.6 mm in the seventh example. In this manner, even in the fourth and fifth examples in which the total number of conductors was greater than that in the second example, it was confirmed that, when the ratio between an average value of diameters of the insulated conductors and an average value of diameters of the non-insulated conductors was set to 8:5 in the fourth example, 2:1 in the fifth example, and about 4:1 in the seventh example, compared to the first and second examples, even if the number of insulated conductors was the same and the number of non-insulated conductors was larger, it was possible to set the size of the outer diameter of all of the insulated conductors and non-insulated conductors to be smaller than those of the first and second examples, it was possible to reduce the diameter of the cable and it was possible to obtain a crosstalk reduction effect.

As shown in FIG. 11, crosstalk was the lowest in the third example (D), and was higher in the sixth example (G), the fourth example (E), the seventh example (H), the fifth example (F), the second example (C), the first example (B), and the comparative example (A) in that order. In the cables of the first to fifth examples, the crosstalk was less than 20 (dB) before the frequency reached a band of about 20 (MHz). Therefore, when a length corresponding to the least common multiple between the small twist pitch and the medium twist pitch was set to be longer and a frequency of appearance of the same surface in cross sections perpendicular to a longitudinal direction in the conductors and the conductor bundles was set to be lower, it was possible to reduce crosstalk.

Also, six cables of the comparative example, the first example, the second example, the third example, the fourth example, and the fifth example were formed at small twist, medium twist and large twist pitches whose sizes ascended. However, in the cable according to the embodiment, the twist pitch does not need to increase when the level becomes higher. In the cable according to the embodiment, for example, one twist pitch of the small twists may be larger than a twist pitch of the medium twist.

Example 2

Next, crosstalks when the ratio between the number of non-insulated conductors and the number of insulated conductors was changed were compared. Here, the ratio between the number of non-insulated conductors and the number of insulated conductors was changed to 0:16, 1:16, 1:8 (2:16), 1:4 (4:16), 1:3 (6:18), 1:2 (8:16), and 1:1 (16:16). Here, the numbers in the parentheses indicate the ratio between the number of non-insulated conductors and the number of insulated conductors when the number of insulators was uniformly 16. Here, the size of a core material of the insulated conductor was 42AWG and the size of the non-insulated conductor was 38AWG.

Figure 12:
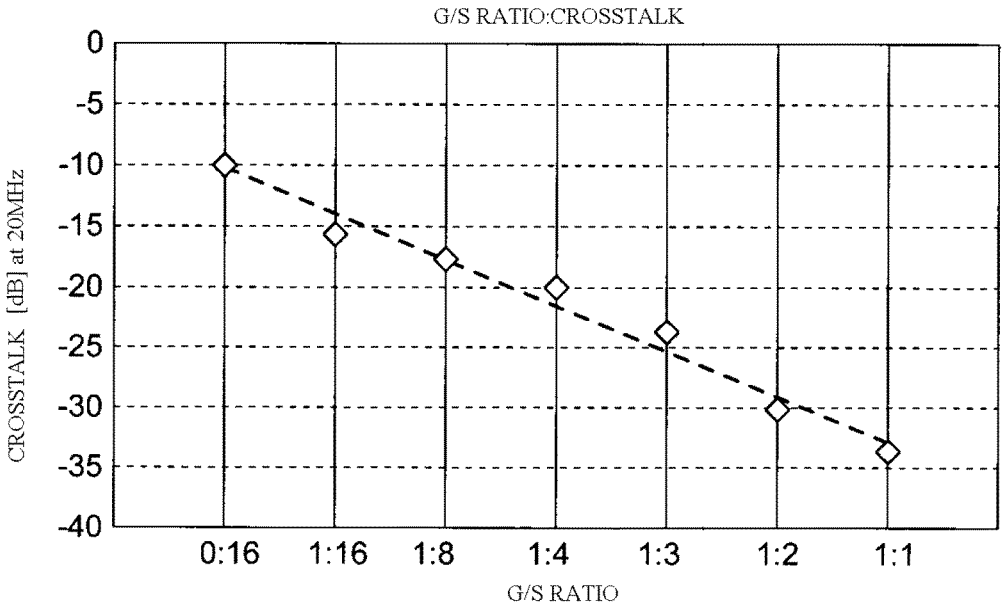
FIG. 12 is a graph showing a change in crosstalk when the ratio between the number of insulated conductors and the number of non-insulated conductors included in the cable is changed if a signal has a frequency of 20 (MHz).

FIG. 12 is a graph showing a change in crosstalk when the ratio between the number of insulated conductors and the number of non-insulated conductors included in the cable was changed if a signal has a frequency of 20 (MHz). In FIG. 12, the horizontal axis represents the ratio between the number of insulated conductors and the number of non-insulated conductors, and the vertical axis represents a magnitude (dB) of crosstalk.

When the ratio between the number of insulated conductors and the number of non-insulated conductors included in the cable is 0:16, the crosstalk is about −10 (dB). When the ratio between the number of insulated conductors and the number of non-insulated conductors included in the cable is 1:4, the crosstalk is about −20 (dB). In addition, when the ratio between the number of insulated conductors and the number of non-insulated conductors included in the cable is 1:1, the crosstalk is about −35 (dB).

Figure 13A:
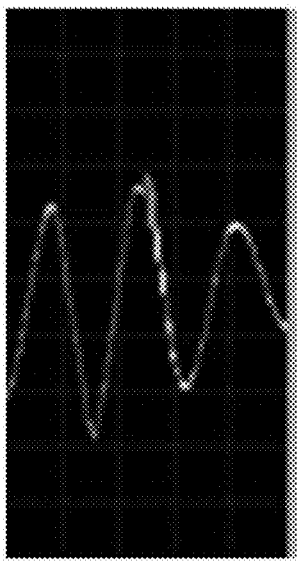
FIG. 13(*a*) is a second diagram describing processes of determining a "frequency of appearance of the same surface in cross sections perpendicular to a longitudinal direction."
Figure 13B:
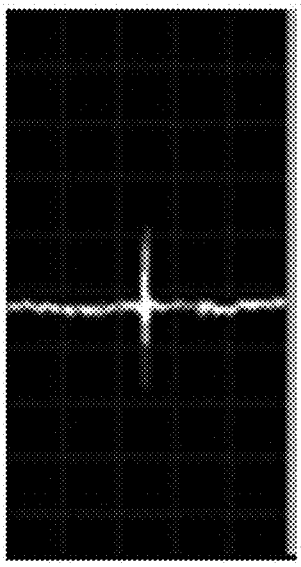

FIG. 13*a* shows a signal state when the crosstalk is smaller than −20 (dB). FIG. 13*b* shows a signal state when the crosstalk is greater than −20 (dB).

As shown in FIG. 13*a*, when the crosstalk was greater than −20 (dB), a bandwidth of a signal became wider and it was not possible to obtain favorable signal characteristics. On the other hand, as shown in FIG. 13(*b*), when the crosstalk was smaller than −20 (dB), a bandwidth of a signal became narrower and it was not possible to obtain favorable signal characteristics. Therefore, it was confirmed that favorable signal characteristics were obtained before 20 (MHz) as described above in the first and second examples in FIG. 11.

Example 3

Next, characteristic impedances and losses when a value obtained by dividing a distance from the center of an insulated conductor to the surface of an adjacent non-insulated conductor by a distance from the center of the insulated conductor to the outermost surface of the insulated conductor was changed were compared. Table 6 show changes in characteristic impedance (Zo) and loss when a value obtained by dividing a distance (L) from the center of an insulated conductor to the surface of an adjacent non-insulated conductor by a distance (l) from the center of the insulated conductor to the outermost surface of the insulated conductor was changed. Here, when (L/l) was 1, this indicated that the non-insulated conductor and the insulated conductor were in contact with each other. When (L/l) was 2, this indicated that a distance between the non-insulated conductor and the insulated conductor was twice a distance from the center of the insulated conductor to the outermost surface of the insulated conductor.

TABLE 6

| L/I | Zo | Loss |
|---|---|---|
| 1 | 100% | 0% |
| 1.1 | 108% | 3% |
| 1.2 | 115% | 7% |
| 1.3 | 120% | 10% |
| 1.4 | 126% | 15% |
| 1.5 | 132% | 18% |
| 1.6 | 138% | 20% |
| 1.7 | 142% | 23% |
| 1.8 | 148% | 26% |
| 1.9 | 152% | 28% |
| 2 | 156% | 30% |

When (L/l) was 1, the loss was 0%. When (L/l) was 1.3, the loss was 10%. When the multi-core cable was used as an ultrasonic probe cable or the like, if the loss exceeded 10%, a favorable transmission performance was not obtained.

The following Table 6 shows combined resistances of insulated conductors and non-insulated conductors when a silver-plated and tin-containing copper alloy was used as a substance of core materials of the insulated conductors and the non-insulated conductors. Here, the combined resistance of the insulated conductors and the non-insulated conductors indicates a resistance value per unit length when the insulated conductors and non-insulated conductors included in the cable are connected in parallel. For example, when the ratio between the number of non-insulated conductors and the number of insulated conductors was 1:16, the combined resistance of the non-insulated conductor indicated a resistance value per unit length of one non-insulated conductor, and the combined resistance of the insulated conductors indicated a resistance value per unit length when 16 insulated conductors were connected in parallel.

TABLE 7

| G:S ratio | G number of non-insulated conductors | G combined resistance | S number of insulated conductors | S combined resistance |
|---|---|---|---|---|
| 0:16 | 0 | — | 16 | 0.45 |
| 1:16 | 1 | 2.38 | 16 | 0.45 |
| 1:8 | 2 | 1.19 | 16 | 0.45 |
| 1:4 | 4 | 0.6 | 16 | 0.45 |
| 1:3 | 6 | 0.4 | 16 | 0.40 |
| 1:2 | 8 | 0.3 | 16 | 0.45 |
| 1:1 | 16 | 0.26 | 16 | 0.45 |

REFERENCE SIGNS LIST

| | |
|---|---|
| 1 | multi-core cable |
| 10, 20, 30, 40 | conductor bundle |
| 11 to 13, 21 to 23, 31 to 33, 41 to 43 | insulated conductor |
| 14, 24, 34, 44 | non-insulated conductor |
| 50 | external shield |
| 60 | sheath |

The invention claimed is:

1. A multi-conductor cable comprising:

n conductor bundles, wherein the n conductor bundles each include at least one insulated conductor and at least one non-insulated conductor, a frequency of appearance of the same surface in cross sections perpendicular to a longitudinal direction is AF(N) (N=1 to n) per unit length, at least one AF(N) (N=1 to n) is different from the others, the ratio between the number of insulated conductors and the number of non-insulated conductors in each of the n conductor bundles is in a range of 2:3 to 4:1, a non-insulated conductor paired with an insulated conductor is not fixed, and each of the insulated conductors is paired with a non-insulated conductor of the same conductor bundle and/or a non-insulated conductor in a different conductor bundle.

2. The multi-conductor cable according to claim 1, wherein the ratio between the number of insulated conductors and the number of non-insulated conductors in each of the n conductor bundles is in a range of 1:1 to 4:1.

3. The multi-conductor cable according to claim 1, wherein the ratio between the number of insulated conductors and the number of non-insulated conductors in each of the n conductor bundles is in a range of 2:3 or more and less than 1:1, and wherein the ratio between an average value of diameters of the insulated conductors and an average value of diameters of the non-insulated conductors in the n conductor bundles is in a range of 1.2:1 or more and 4:1 or less.

4. The multi-conductor cable according to claim 1, wherein, in the cross sections perpendicular to a longitudinal direction, an average value of values obtained by dividing the shortest distance from the center of each of the insulated conductors of the n conductor bundles to the surface of the adjacent non-insulated conductor by a distance from the center of the insulated conductor to the outermost surface of the insulated conductor is in a range of 1 to 1.3.

5. The multi-conductor cable according to claim 1, wherein the frequency of appearance of the same surface in cross sections perpendicular to a longitudinal direction of all of the n conductor bundles is 0.01 turns/m or less.

6. The multi-conductor cable according to claim 1, wherein a combined resistance when the insulated conductors of the n conductor bundles are connected in parallel is higher than a combined resistance when the non-insulated conductors of the n conductor bundles are connected in parallel.

7. A multi-conductor cable comprising:

n conductor bundles, wherein the n conductor bundles each include at least one insulated conductor and at least one non-insulated conductor, the at least one insulated conductor and the at least one non-insulated conductor are twisted T(N) (N=1 to n) times per unit length, the n conductor bundles are twisted T1 times per unit length, at least one T(N) (N=1 to n) is different from the others, the ratio between the number of insulated conductors and the number of non-insulated conductors in each of the n conductor bundles is in a range of 2:3 to 4:1, and a non-insulated conductor paired with an insulated conductor is not fixed, and each of the insulated conductors is paired with a non-insulated conductor of the same conductor bundle and/or a non-insulated conductor of a different conductor bundle.

8. A method of producing a multi-conductor cable comprising:

twisting n conductor bundles each including at least one insulated conductor and at least one non-insulated conductor in which the at least one insulated conductor and the at least one non-insulated conductor are in a longitudinal direction of the conductor bundles T(N) (N=1 to n) times per unit length, and twisting the twisted n conductor bundles as a collected conductor group in a longitudinal direction of the conductor group T1 times per unit length, wherein at least one T(N) (N=1 to n) is different from the others, the ratio between the number of insulated conductors and the number of non-insulated conductors in each of the n conductor bundles is in a range of 2:3 to 4:1, and a non-insulated conductor paired with an insulated conductor is not fixed, and each of the insulated conductors is paired with a non-insulated conductor of the same conductor bundle and/or a non-insulated conductor of a different conductor bundle.

* * * * *